US005580053A

United States Patent [19]

Crouch

[11] Patent Number: 5,580,053

[45] Date of Patent: Dec. 3, 1996

[54] MULTI-LINE GAMING MACHINE

[76] Inventor: Philip C. Crouch, 8 Davies Avenue, 2030 Vaucluse, New South Wales, Australia

[21] Appl. No.: 360,532

[22] Filed: Dec. 21, 1994

[30] Foreign Application Priority Data

Aug. 22, 1994 [AU] Australia ..... PM7599

[51] Int. Cl.[6] ..... G07F 17/34

[52] U.S. Cl. ..... 463/20

[58] Field of Search ..... 273/138 A,142 R, 273/142 B, 142 D, 142 H

[56] References Cited

U.S. PATENT DOCUMENTS 5,209,479 5/1993 Nagao et al. ..... 273/138 A X
5,393,061 2/1995 Manship et al. ..... 273/138 A
5,401,024 3/1995 Simunek ..... 273/138 A
5,423,539 6/1995 Nagao ..... 273/138 A X
5,423,541 6/1995 Nicastro et al. ..... 273/138 A

*Primary Examiner*—William E. Stoll
*Attorney, Agent, or Firm*—Anderson, Kill & Olick P.C.

[57] ABSTRACT

A gaming machine 50 has a display 51 on which an array of symbols is displayed. The array is typically 3 rows×5 columns and during a game the symbols displayed on the array are caused to change with a random result being obtained. The player of the machine makes a wager on the result and is paid a prize if one of a number of predetermined combinations of symbols are displayed on a line of the display 51 at the end of the game. The player may make multiple wagers on each game with each wager being assigned to a different one of a plurality of possible result lines. typically, the number of possible result lines is greater than or equal to 9 and the lines to be employed in each game are selected by switches 54, prior to a game being initiated.

6 Claims, 21 Drawing Sheets

MULTI-LINE GAMING MACHINE

The present invention relates to gaming machines of the type generally referred to as slot machines, fruit machines or poker machines, and in particular the invention provides an improvement to a game played on such a machine.

Players who regularly play gaming machines quickly tire of particular games and therefore it is necessary for manufacturers of these machines to come up with innovative game features that add interest to the games provided on such machines in order to keep the players amused and therefore willing to continue playing the game.

DESCRIPTION OF THE PRIOR ART

Gaming or poker machines have been well known in the state of New South Wales for many years and have more recently gained considerable popularity throughout Australia, with quite substantial amounts of money wagered on these machines. Such machines have also been popular in various casinos throughout the world for many years. There is a growing tendency for State governments to legalise the use of gaming machines by licensing operators, with resulting revenue gains through licence fees and taxation of monies invested. The licensed operation of gaming machines is the subject of State legislation and regulation. This regulation most always dictates a minimum percentage payout for a gaming machine. For example, a minimum of 85% of monies invested must be returned as winnings, and manufacturers of gaming machines therefore must design their machines around these regulatory controls.

With the growth that has occurred in the gaming machine market there is intense competition between manufacturers to supply the various existing and new venues. When selecting a supplier of gaming machines, the operator of a venue will often pay close attention to the popularity of various games with their patrons. Therefore, gaming machine manufacturers are keen to devise games which are popular with players, as a mechanism for improving sales.

Many various strategies have been tried in the past to make games more enticing to players, and these strategies are often aimed at either increasing the maximum prize payable on a machine or creating at least the perception of more winning opportunities. The present invention falls into the latter category For quite a few years, it has been possible to bet on more than one pay line of a slot machine simultaneously. However this feature has been restricted by the number of pay lines that could be achieved on the display format commonly used in slot machines.

The present invention provides an arrangement whereby the number of pay lines provided on a slot machine, particularly a machine with 3×5 display, can be increased without changing the display format.

SUMMARY OF THE INVENTION

The present invention consists in a gaming machine having display means arranged to display a plurality of symbols in an array of a predetermined number of rows and columns of symbol locations, game control means arranged to control images displayed on the display means, the game control means being arranged to pay a prize when a predetermined combination of symbols is displayed on a predetermined line of symbol locations of the array characterised in that the number of possible predetermined lines recognised by the control means is greater than the number of rows plus a number of diagonals of the array, there being at least n+1 lines that use no symbols in at least 1 row, where n is the number of rows.

In the preferred embodiments, at least one of the lines is made up of a number of segments, each of which have no more than two symbols arranged in a straight line segment.

In a further embodiment, at least one line has more than n straight line segments.

The preferred embodiments of the invention use a display means which displays symbols in 3 rows and 3, 4 or 5 columns.

In one embodiment in which the display means provides 5 columns of symbols, nine pay lines are provided, while in other embodiments twelve, thirteen, fifteen, twenty-one and twenty-seven pay lines are provided. In some embodiments of the invention at least one pay line is not symmetrical about a central column of the array of symbols.

Preferably, in embodiments of the present invention the number of lines passing through each symbol position will be in the range (0.7)l/n to (1.5)l/n where l is the total number of lines and n is the number of rows of symbol positions.

In further embodiments of the invention all possible combinations comprising one symbol position in each display column are used to provide $n^m$ lines where n is the number of rows and m is the number of columns in the array of symbols.

In this embodiment some lines will be discontinuous in that symbol positions in adjacent columns will not be horizontally or diagonally adjacent. Further embodiments may make use of any subset of the $n^m$ lines.

BRIEF DESCRIPTION OF THE DRAWINGS

Embodiments of the present invention will now be described by way of example with reference to the accompanying drawings in which.

DETAILED DESCRIPTION OF THE PREFERRED EMBODIMENTS

In the following detailed description, the methodologly of the embodiments will be described and it is to be understood that it is within the capabilities of the non-inventive worker in the art to introduce the methodologly on any standard microprocessor base gaming machine by means of appropriate programming.

Traditional slot machines have made use of spinning reels to provide a display function with symbols carried on the reels being aligned to produce a game result which may or may not be a winning combination. Traditionally such machines paid a prize only on a centre row combination, however over the years more complex pay arrangements have been developed in which winning combinations could appear on horizontal lines above and below the centre row line, and later on diagonal lines (typically on 3 reel machines).

In more recent times video displays have been used to simulate spinning reels on these types of machines and in some instances machines have been provided with matrices of pseudo spinning wheels such as a 3×3 matrix of reels, whereby every single position on the display screen is essentially independently randomly achieved and therefore it was valid to pay on vertical combinations as well as horizontal combinations. In such a machine with a 3×3 symbol matrix display, winning combinations could be achieved on any one of three horizontal pay lines, three vertical paylines and two diagonals, making 8 possible lines on which a result could be assessed.

It is normal for machines of the type having multiple pay lines available, that the player would purchase the option of playing for a win on lines other than the centre line. That is to say, if the player wagered only one token he played only for a winning combination on one line, whereas if he wagered a number of tokens he may well select to wager some of those tokens on lines other than the centre line of the display.

This mechanism adds interest to the game being played by the player as essentially it enables him to make multiple bets simultaneously.

Figure 1:
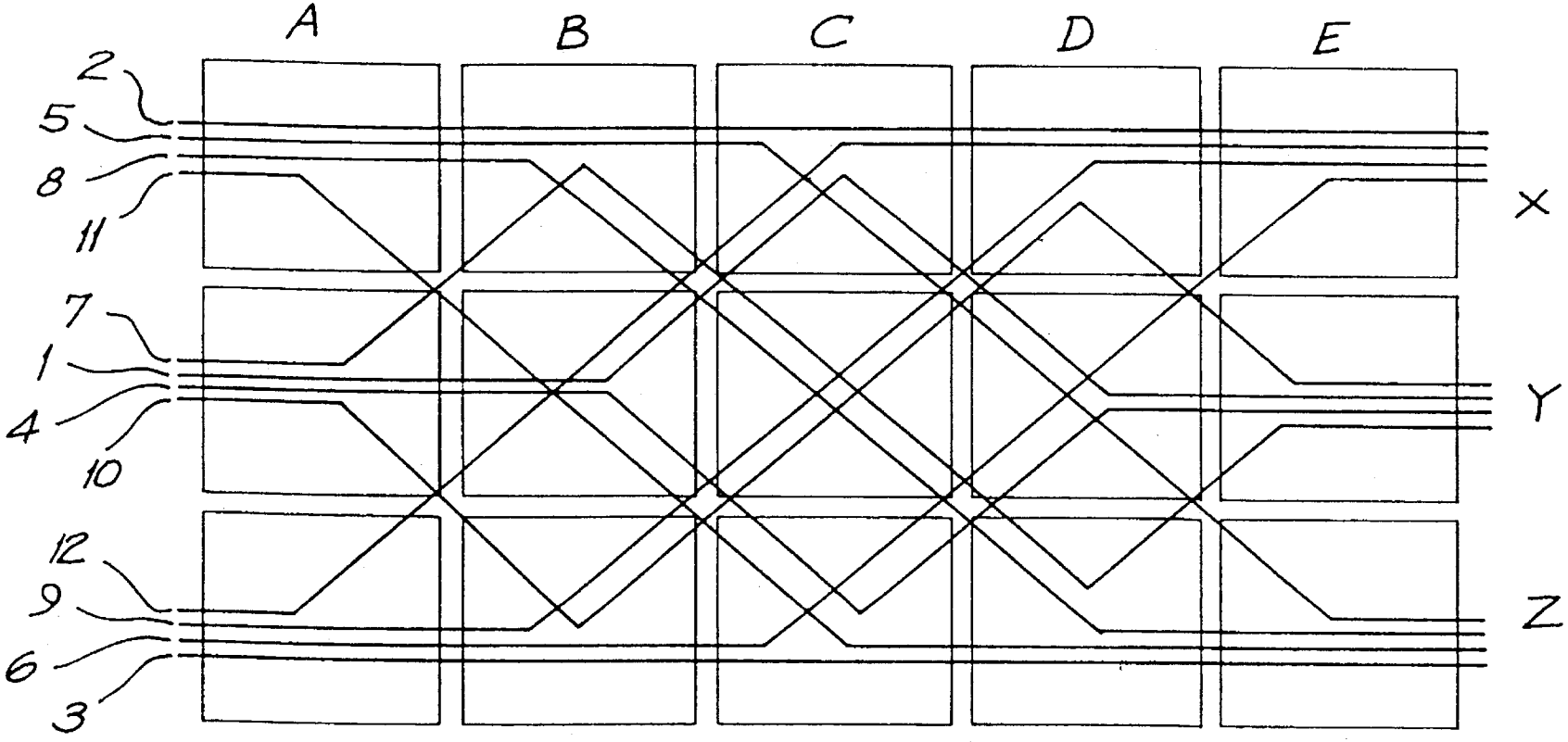
FIG. 1 diagramatically illustrates a 12 line multi-line pay arrangement for a machine with a 3×5 display format.

Referring to FIG. 1, a matrix symbolic of a typical three line by five column display matrix is illustrated, and it will be immediately apparent that in such an arrangement diagonal pay lines as conventionally used in 3×3 symbol matrix machines are not appropriate to the 3×5 format. Similarly, in slot machines which play games which follow the traditional format of a plurality of vertical spinning reels, vertical pay lines are not appropriate as there is no significant degree of randomness in the combinations provided on the vertical line.

Therefore, with this in mind the first embodiment of the present invention provides an arrangement for a slot machine having a 3×5 symbol maxtrix display with 12 possible pay lines as illustrated in the diagram of FIG. 1. Referring to the symbol positions of the display by their matrix row and column designations (e.g. AX for the top left hand corner and EZ for the bottom right hand corner). It will be noted that the first row in this arrangement comprises the symbol positions AY, EY, CX, DY, EY and the twelfth line comprises the symbol positions AZ, BY, CX, DX, EX. All of the line combinations of FIG. 1 are illustrated in Table 1 below

TABLE 1

| LINE NO | DISPLAY POSITIONS USED | | | | |
|---|---|---|---|---|---|
| 1 | AY, | BY, | CX, | DY, | EY |
| 2 | AX, | BX, | CX, | DX, | EX |
| 3 | AZ, | BZ, | CZ, | DZ, | EZ |
| 4 | AY, | BY, | CZ, | DY, | EY |
| 5 | AX, | BX, | CX, | DY, | EZ |
| 6 | AZ, | BZ, | CZ, | DY, | EX |
| 7 | AY, | BX, | CY, | DZ, | EZ |
| 8 | AX, | BX, | CY, | DZ, | EZ |
| 9 | AZ, | BZ, | CY, | DX, | EX |
| 10 | AY, | BZ, | CY, | DX, | EX |
| 11 | AX, | BY, | CZ, | DZ, | EZ |
| 12 | AZ, | BY, | CX, | DX, | EX |
| (13) | (AY), | (BY), | (CY), | (DY), | (EY) |

It will be noted that in order to achieve the 12 pay lines there are a number of paylines which include at least four separate line segments, each of which is only two symbols long. For example line number 1 has a first segment AY, BY, a second segment BY, CX, a third segment CX, DY and a fourth segment DY, EY, each of which span no more than two symbols. Line number 1 also has the unusual characteristic that it spans more than one row of the symbol display but does not span all of the rows of this symbol display using only rows X and Y. Line number 4 has similar characteristics, spanning only rows Y and Z and this line also includes four short segments.

Another characteristic which is employed to obtain more lines in the standard display format is the use of non-symmetrical lines such as line 11 which has a first diagonal portion AX, BY, CZ and a second horizontal portion CZ, DZ, EZ. This line has no axis of symmetry.

Figure 2:
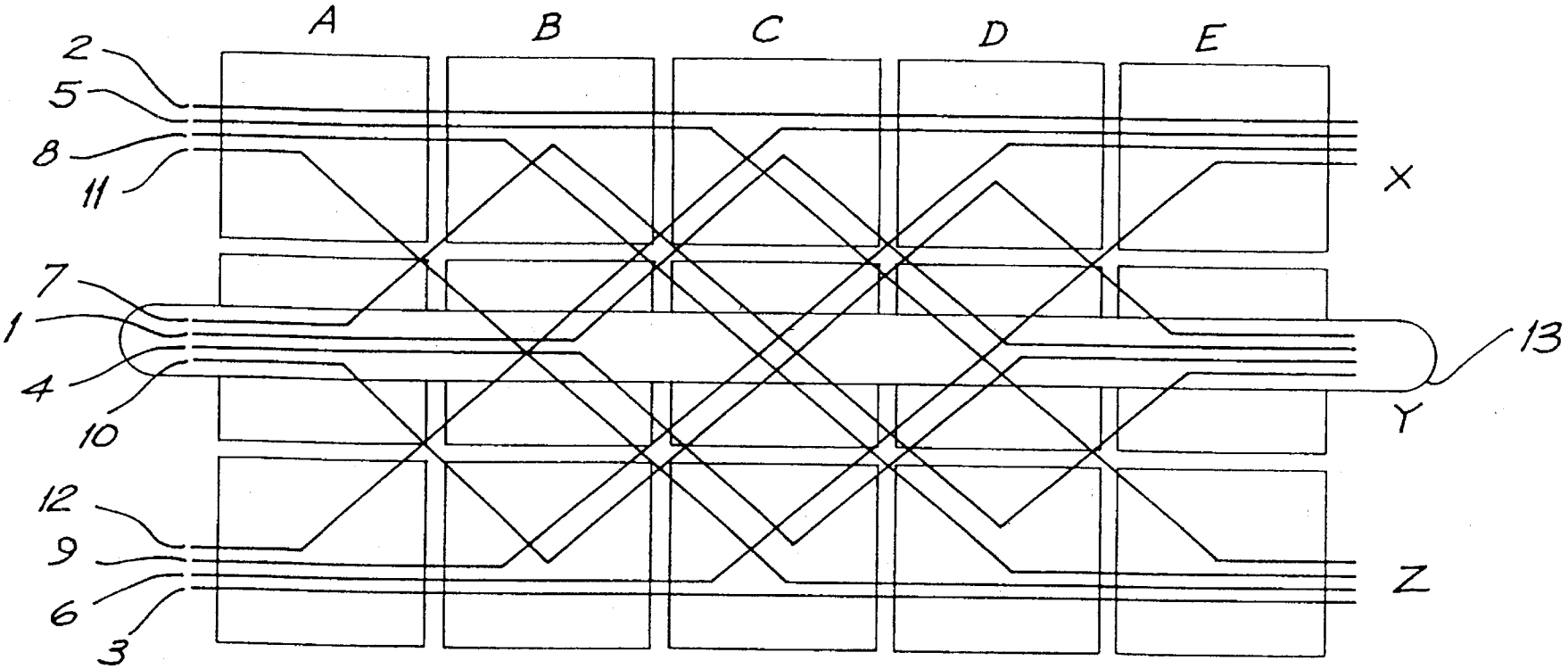
FIG. 2 diagrammatically illustrates a 13 line multi-line pay arrangement for a machine with a 3×5 display format.

Referring to FIG. 2, the arrangement illustrated is essentially identical to that of FIG. 1 except a 13the pay line has been added, that being the horizontal centre line designated by symbol positions AY, BY, CY, DY, EY and this combination is shown in the bracketed 13the line of Table 1.

Figure 3:
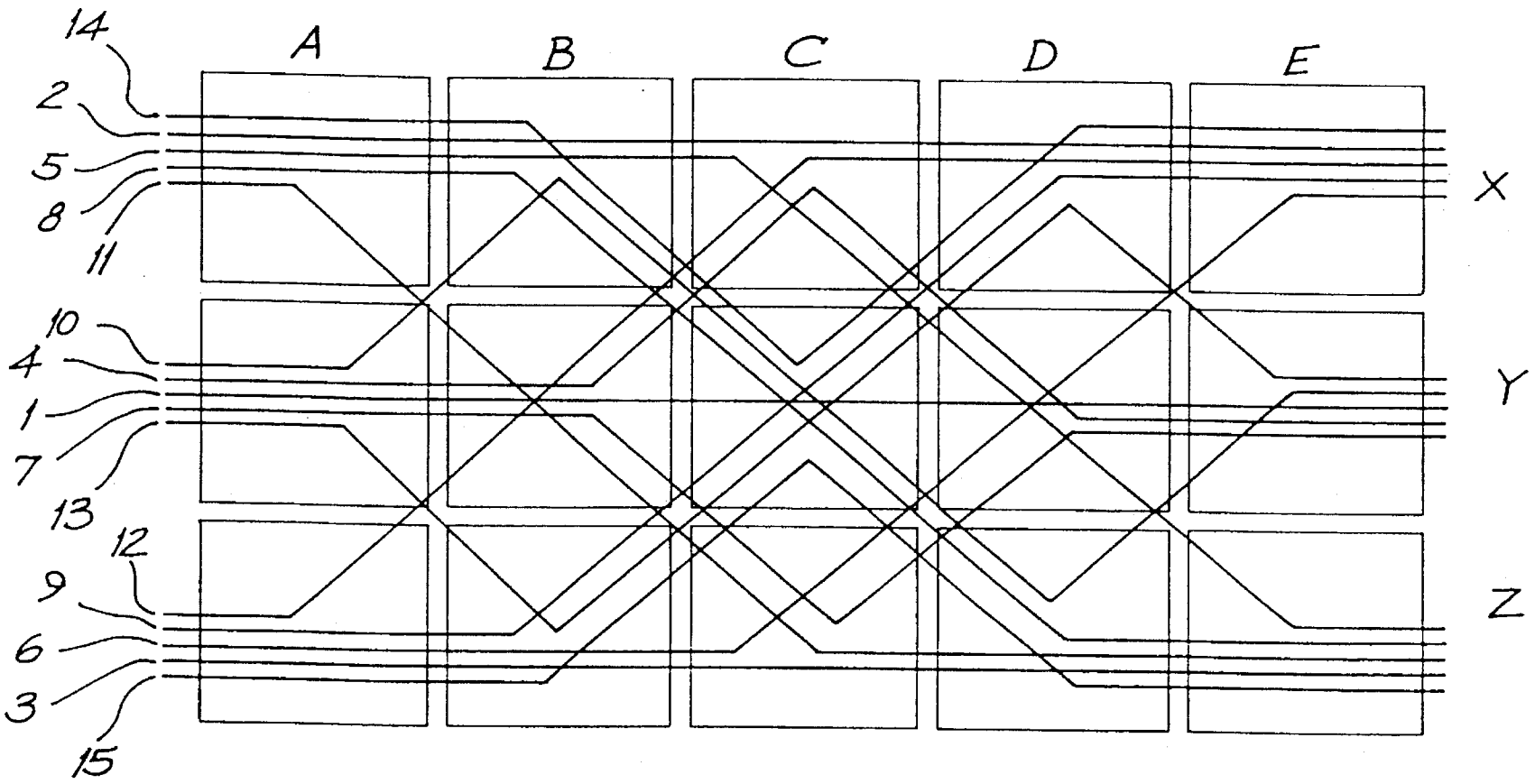
FIG. 3 diagrammatically illustrates a 15 line multi-line pay arrangement for a machine with a 3×5 display format.

Turning to FIG. 3, this arrangement has 15 lines, 13 of which are the same as those shown in FIG. 2 and Table 1 (including the 13the line) and two additional lines 14 and 15, the symbol positions of which are illustrated in Table 2 below. Each of these additional lines makes use of four symbols on either the first or third row of the display array with a deviation to the centre row in the centre column.

TABLE 2

| LINE NO | DISPLAY POSITIONS USED | | | | |
|---|---|---|---|---|---|
| 14 | AX, | BX, | CY, | DX, | EX |
| 15 | AZ, | BZ, | CY, | DZ, | EZ |

Figure 4:
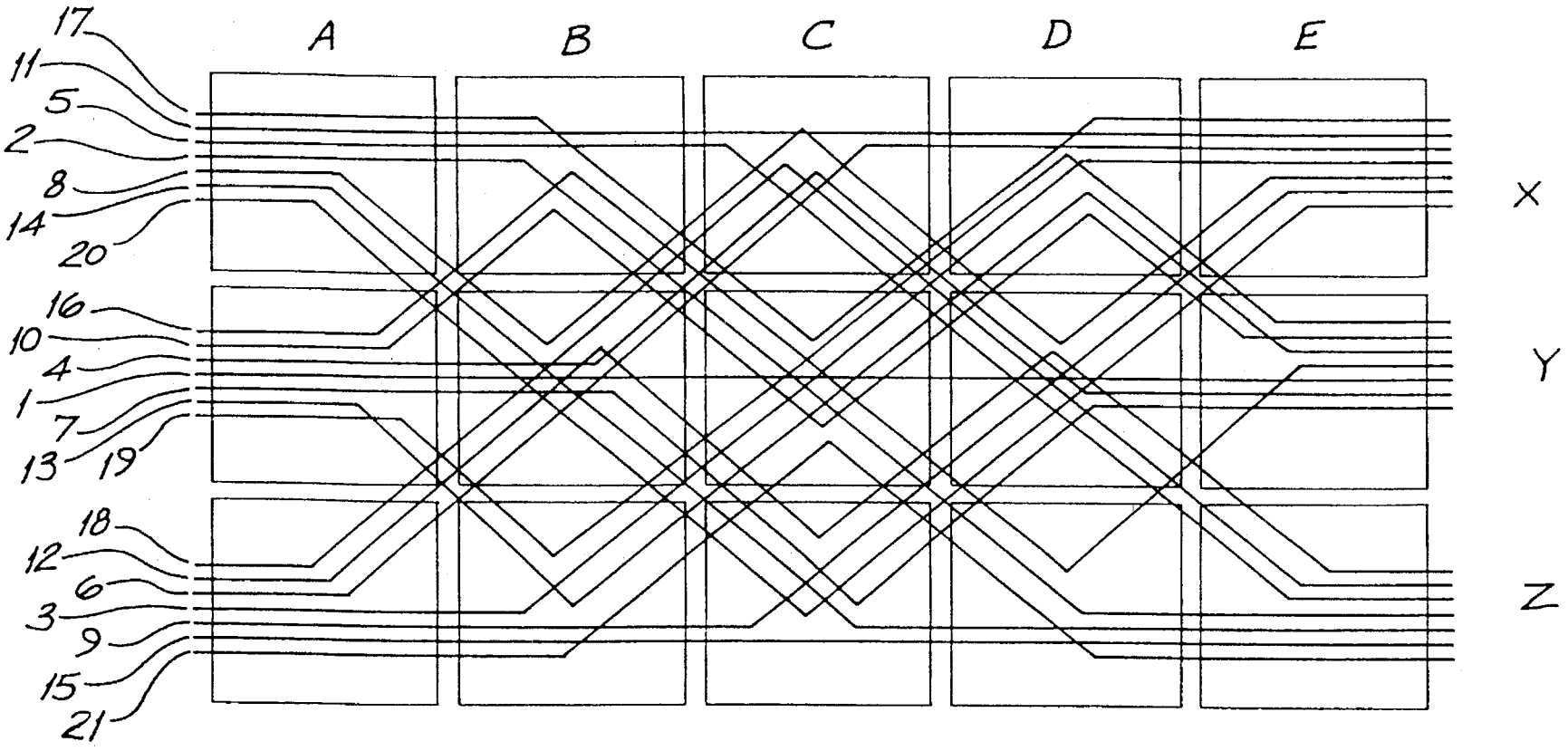
FIG. 4 diagrammatically illustrates a 21 line multi-line pay arrangement for a machine with a 3×5 display format.

Referring to FIG. 4, this arrangement has 21 lines illustrated, fifteen of which are identical to those shown in FIG. 3. Four of the lines in the FIG. 4 embodiment are zig-zag lines occupying two rows of the display and alternating between those rows for each column of the display. These lines are 12, 8, 20 and 13. The remaining two additional lines are lines 18 and 10 and in each case these comprise two diagonal components starting at one corner of the display and progressing to the opposite vertical extremity in the centre column before returning to the original vertical extremity in the last column of the display.

The addition combinations used in FIG. 4 are shown in Table 3 below.

TABLE 3

| LINE NO | DISPLAY POSITIONS USED | | | | |
|---|---|---|---|---|---|
| 18 | AZ, | BY, | CZ, | DY, | EZ |
| 21 | AZ, | BY, | CX, | DY, | EZ |
| 14 | AX, | BY, | CX, | DY, | EX |
| 20 | AX, | BY, | CZ, | DY, | EX |
| 10 | AY, | BX, | CY, | DX, | EY |
| 13 | AY, | BZ, | CY, | DZ, | EY |

Turning to FIG. 5, this is once again a twenty-one line embodiment, however, six of the lines used in the previous embodiment have been replaced, these being lines 19, 16, 8, 5, 12 and 9. In each instance the lines in FIG. 5 which are different to those previously employed occupy two rows of the display but are not zig-zag, either deviating from their original line for two or three symbol positions before returning. The combinations which are different are listed in Table 4 below.

TABLE 4

| LINE NO | DISPLAY POSITIONS USED | | | | |
|---|---|---|---|---|---|
| 10 | AY, | BZ, | CZ, | DZ, | EY |
| 16 | AY, | BX, | CX, | DX, | EY |
| 8 | AX, | BY, | CY, | DX, | EX |
| 5 | AX, | BX, | CY, | DY, | EX |
| 12 | AZ, | BY, | CY, | DZ, | EZ |
| 9 | AZ, | BZ, | CY, | DY, | EZ |

Figure 5:
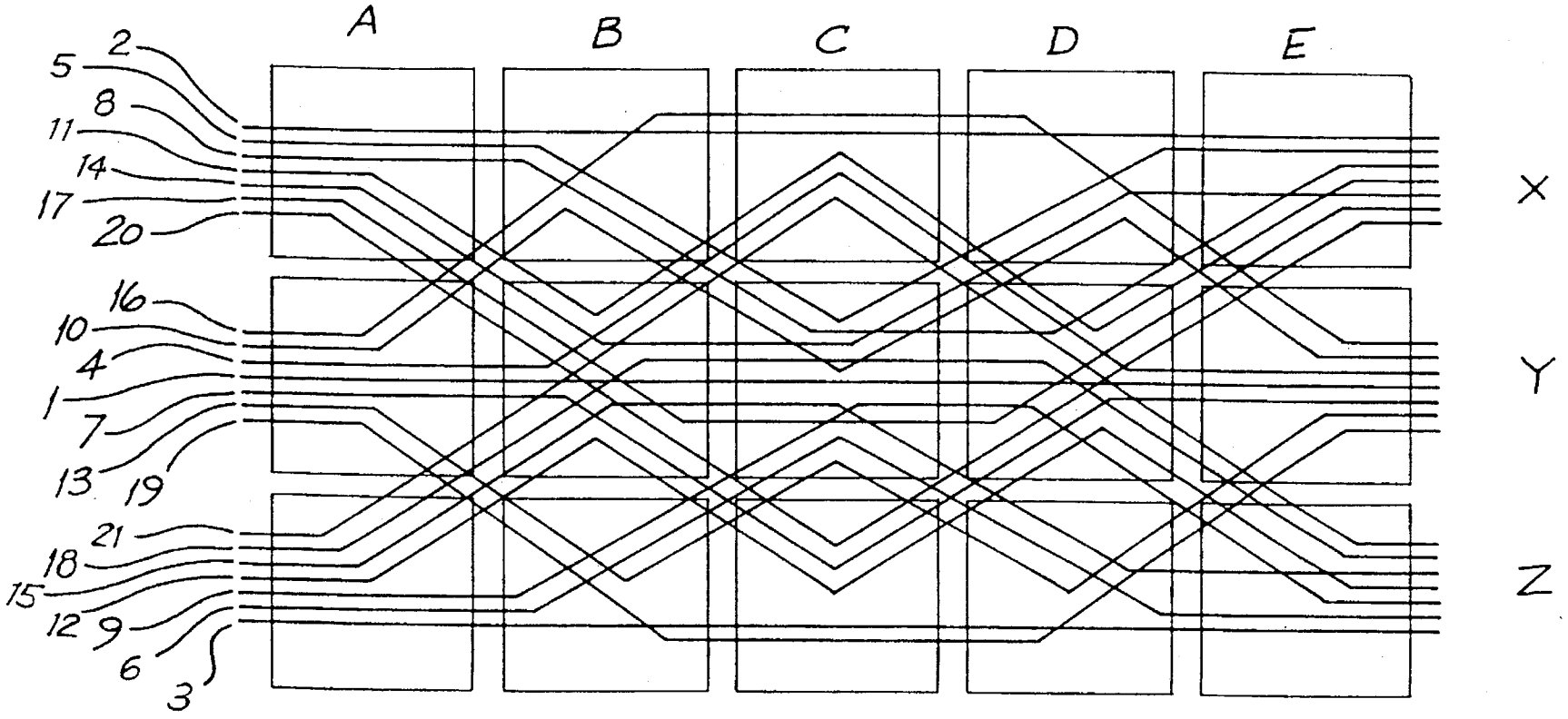
FIG. 5 diagrammatically illustrates a further 21 line multi-line pay arrangement for a machine with a 3×5 display format.
Figure 6:
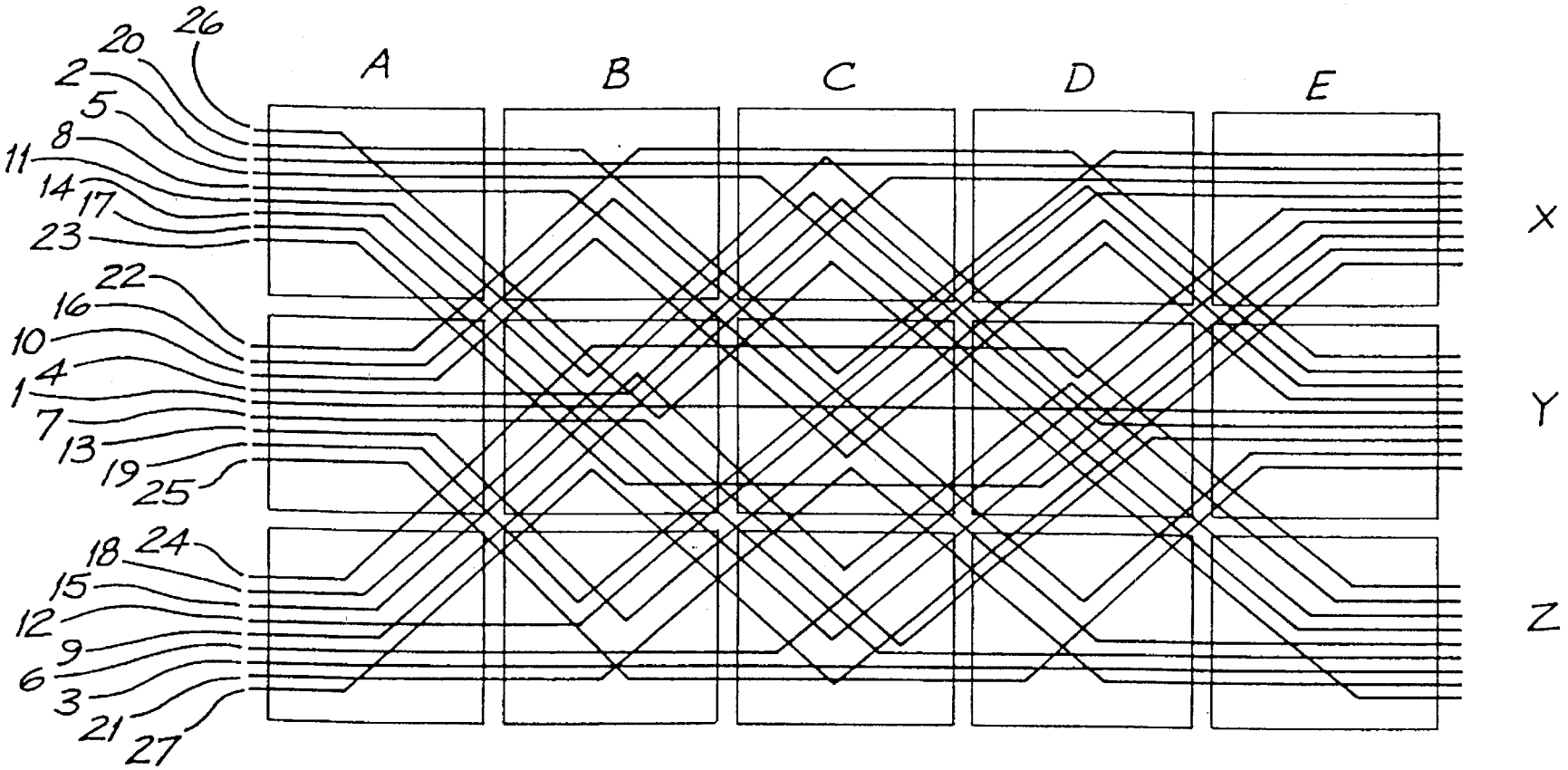
FIG. 6 diagrammatically illustrates a 27 line multi-line pay arrangement for a machine with a 3×5 display format.
Figure 7:
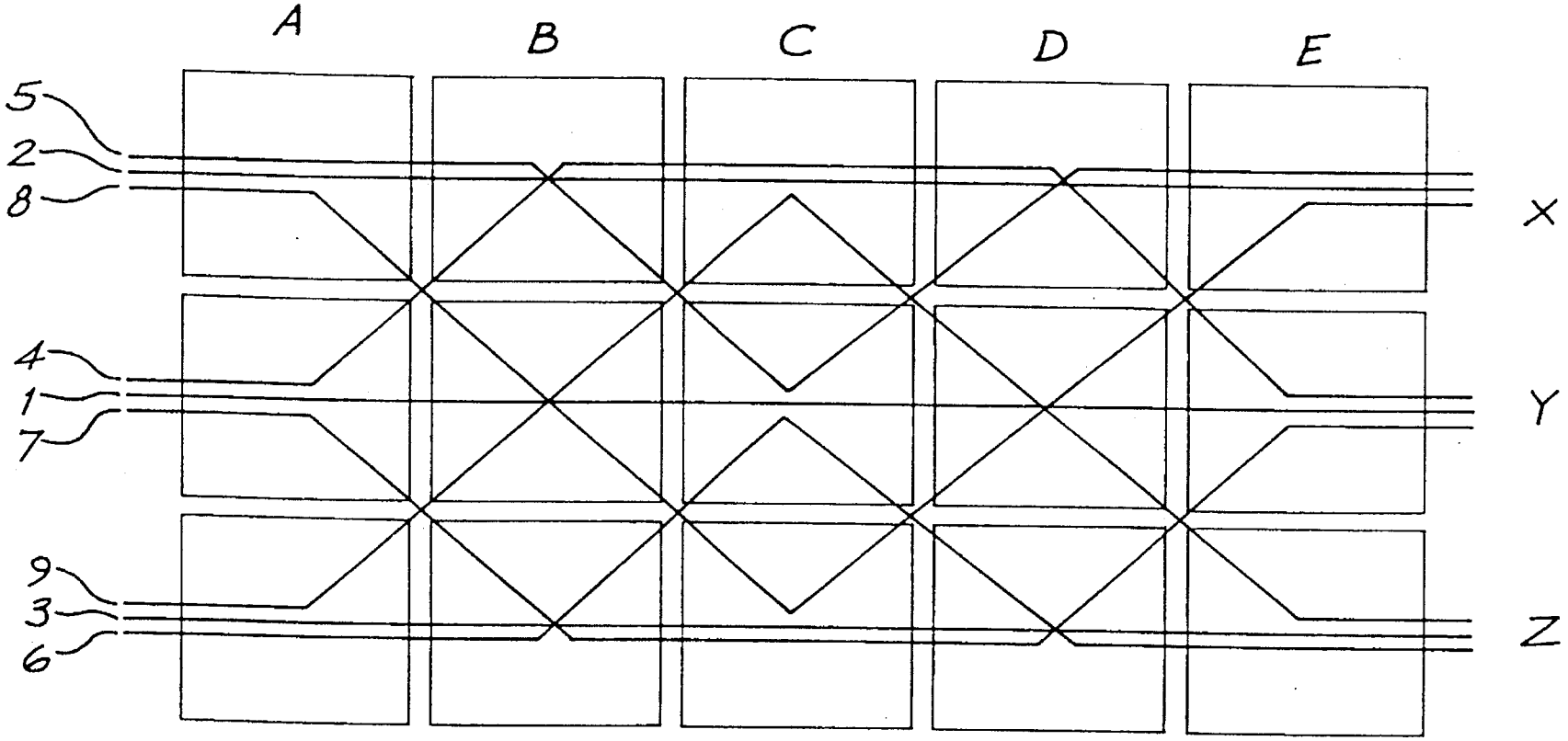
FIG. 7 diagrammatically illustrates a 9 line multi-line pay arrangement for a machine with a 3×5 display format.

By combining the embodiments of FIGS. 4 and 5 (and tables 1, 2, 3, & 4), a 27 line embodiment is achieved as illustrated in FIG. 6, while FIG. 7 shows a 9 line embodiment making use of a selection of these lines, as set out in Table 5.

TABLE 5

| LINE NO | DISPLAY POSITIONS USED | | | | |
|---|---|---|---|---|---|
| 1 | AY, | BY, | CY, | DY, | EY, |
| 2 | AX, | BX, | CX, | DX, | EX, |
| 3 | AZ, | BZ, | CZ, | DZ, | EZ, |

TABLE 5-continued

| LINE NO | DISPLAY POSITIONS USED | | | | |
|---|---|---|---|---|---|
| 4 | AY, | BX, | CX, | DX, | EY, |
| 5 | AX, | BX, | CY, | DX, | EX, |
| 6 | AZ, | BZ, | CY, | DZ, | EZ, |
| 7 | AY, | BZ, | CZ, | EZ, | EY, |
| 8 | AX, | BY, | CZ, | DY, | EX, |
| 9 | AZ, | BY, | CX, | DY, | EZ, |

To this point, the invention has been described with reference to machines having a 3×5 display format. However, the invention in its most general form is equally applicable to machines having a 3×3 or 3×4 display format as illustrated in FIGS. 8 to 12.

Figure 8:
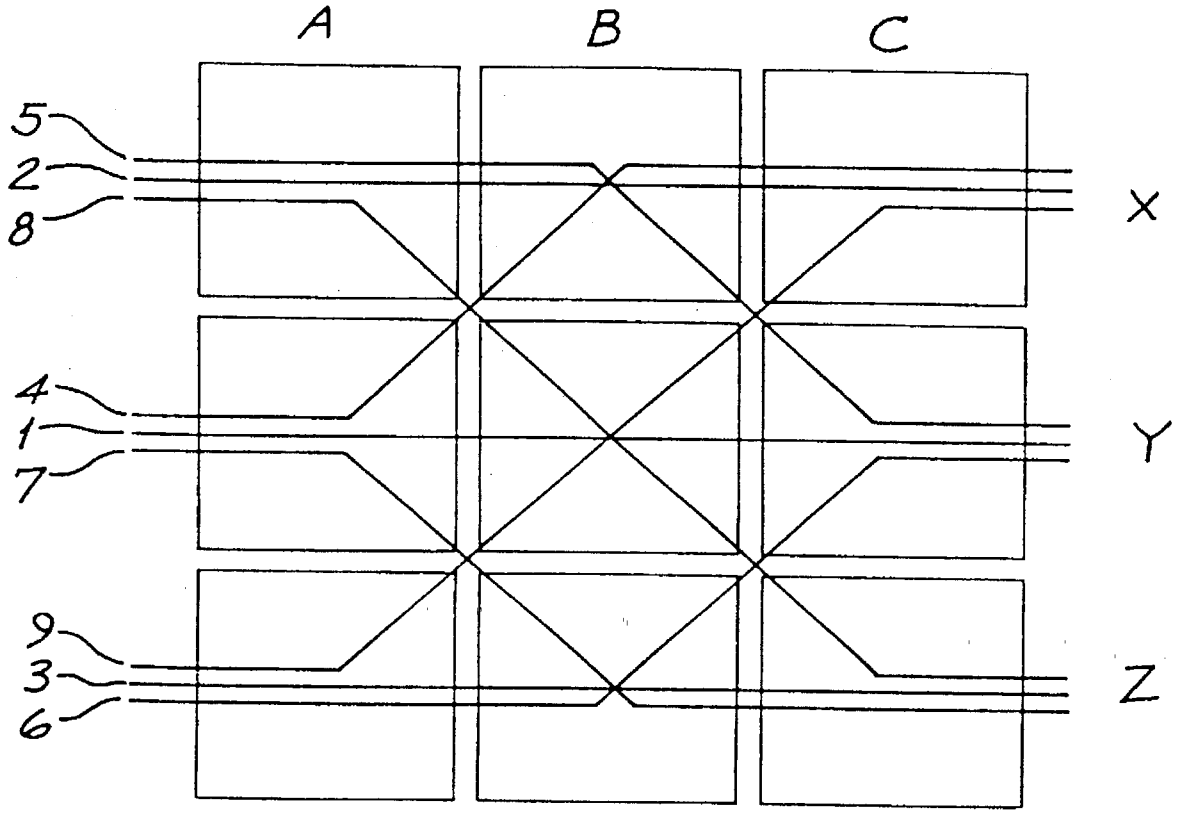
FIG. 8 diagrammatically illustrates a 9 line multi-line pay arrangement for a machine with a 3×3 display format.

The embodiment of FIG. 8 is a first nine line embodiment for a 3×3 machine, for which the lines used are set out in Table 6.

TABLE 6

| LINE NO | DISPLAY POSITIONS USED | | |
|---|---|---|---|
| 1 | AY, | BY, | CY, |
| 2 | AX, | BX, | CX, |
| 3 | AZ, | BZ, | CZ, |
| 4 | AY, | BX, | CX, |
| 5 | AX, | BX, | CY, |
| 6 | AZ, | BZ, | CY, |
| 7 | AY, | BZ, | CZ, |
| 8 | AX, | BY, | CZ, |
| 9 | AZ, | BY, | CX, |

Figure 9:
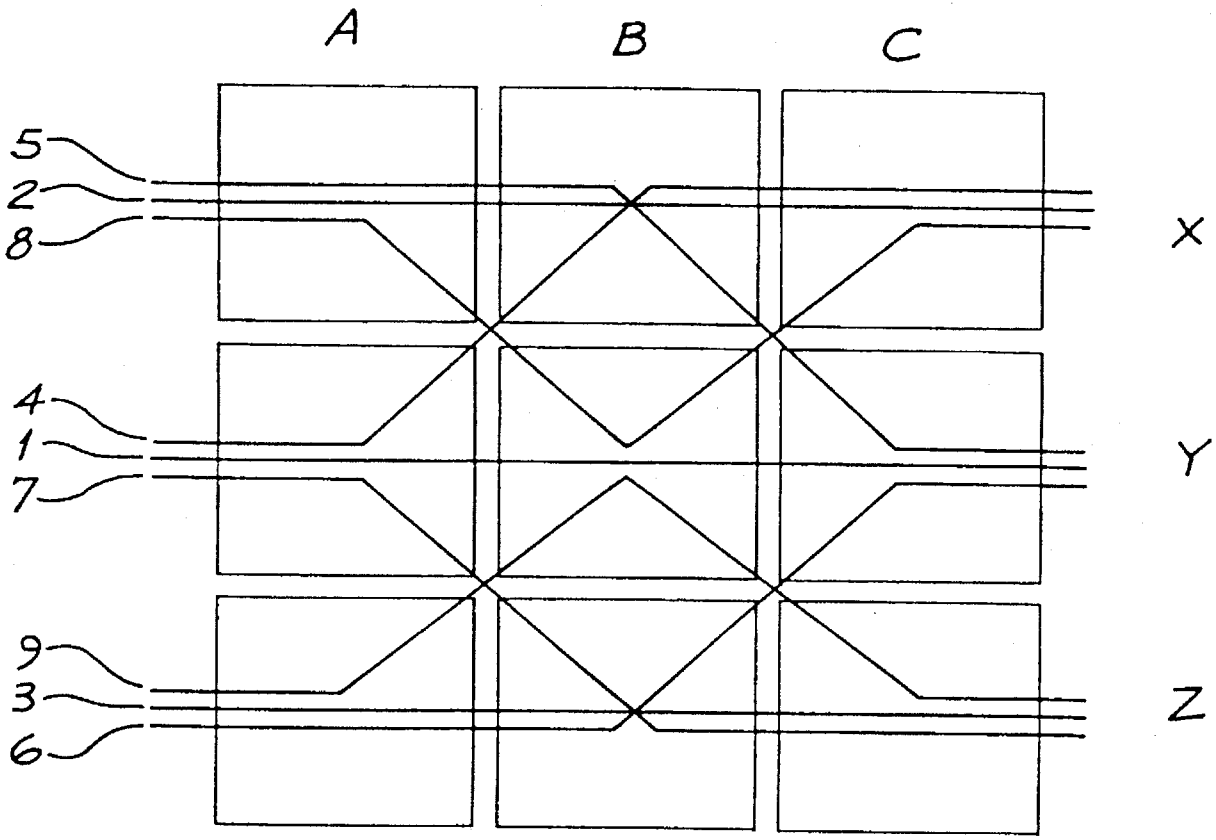
FIG. 9 diagrammatically illustrates a further 9 line multi-line pay arrangement for a machine with a 3×3 display format.

A second nine line embodiment for a 3×3 machine is shown in FIG. 9. This embodiment uses all but lines 8 and 9 of the embodiment of FIG. 8 which are replaced by the lines defined in Table 7.

TABLE 7

| LINE NO | DISPLAY POSITIONS USED | | |
|---|---|---|---|
| 8 | AX, | BY, | CX, |
| 9 | AZ, | BY, | CZ, |

Figure 10:
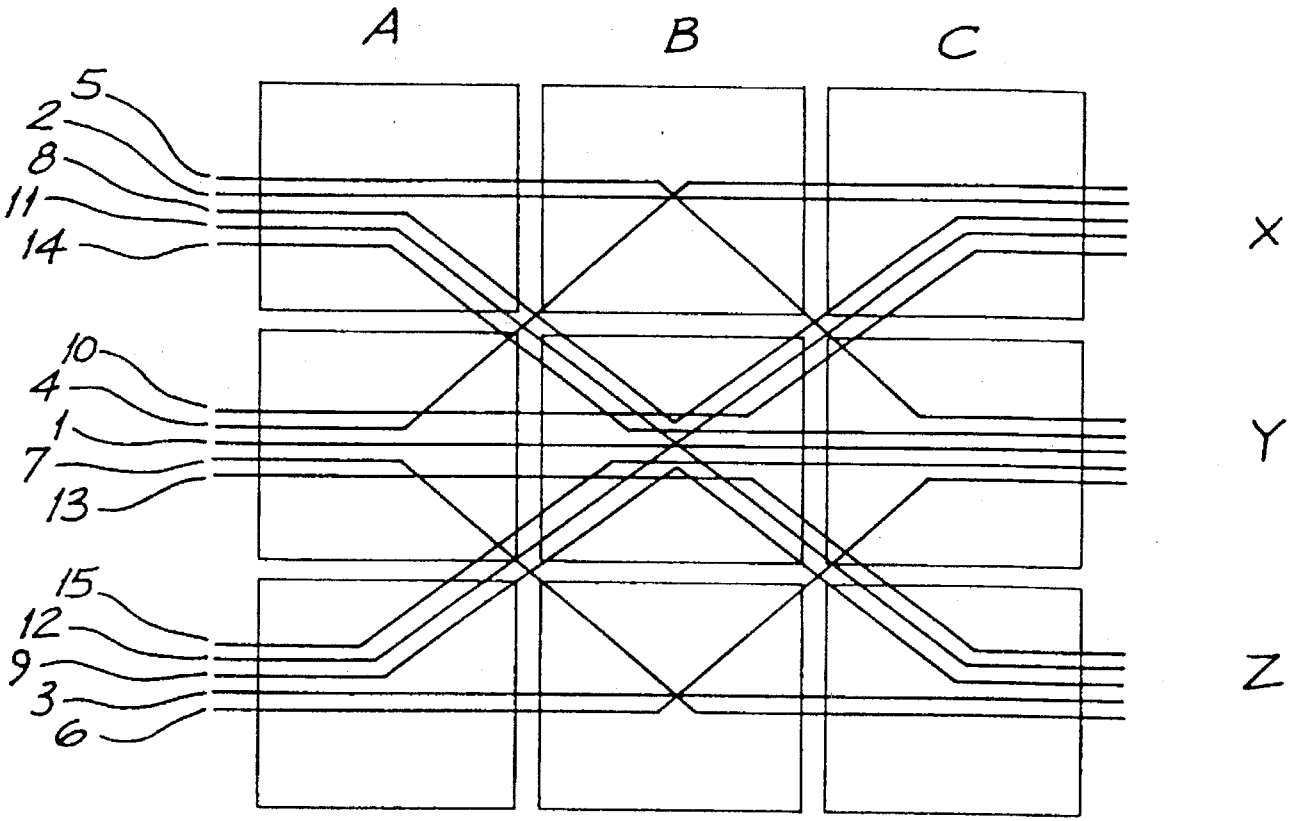
FIG. 10 diagrammatically illustrates a 15 line multi-line pay arrangements for a machine with a 3×3 display format.

FIG. 10 illustrates a 15 line embodiment for a 3×3 machine, in which all of the lines defined in Tables 6 and are used together with the new lines defined in Table 8.

TABLE 8

| LINE NO | DISPLAY POSITIONS USED | | |
|---|---|---|---|
| 10 | AY, | BY, | CX, |
| 13 | AY, | BY, | CZ, |
| 14 | AX, | BY, | CY, |
| 15 | AZ, | BY, | CY, |

Figure 11:
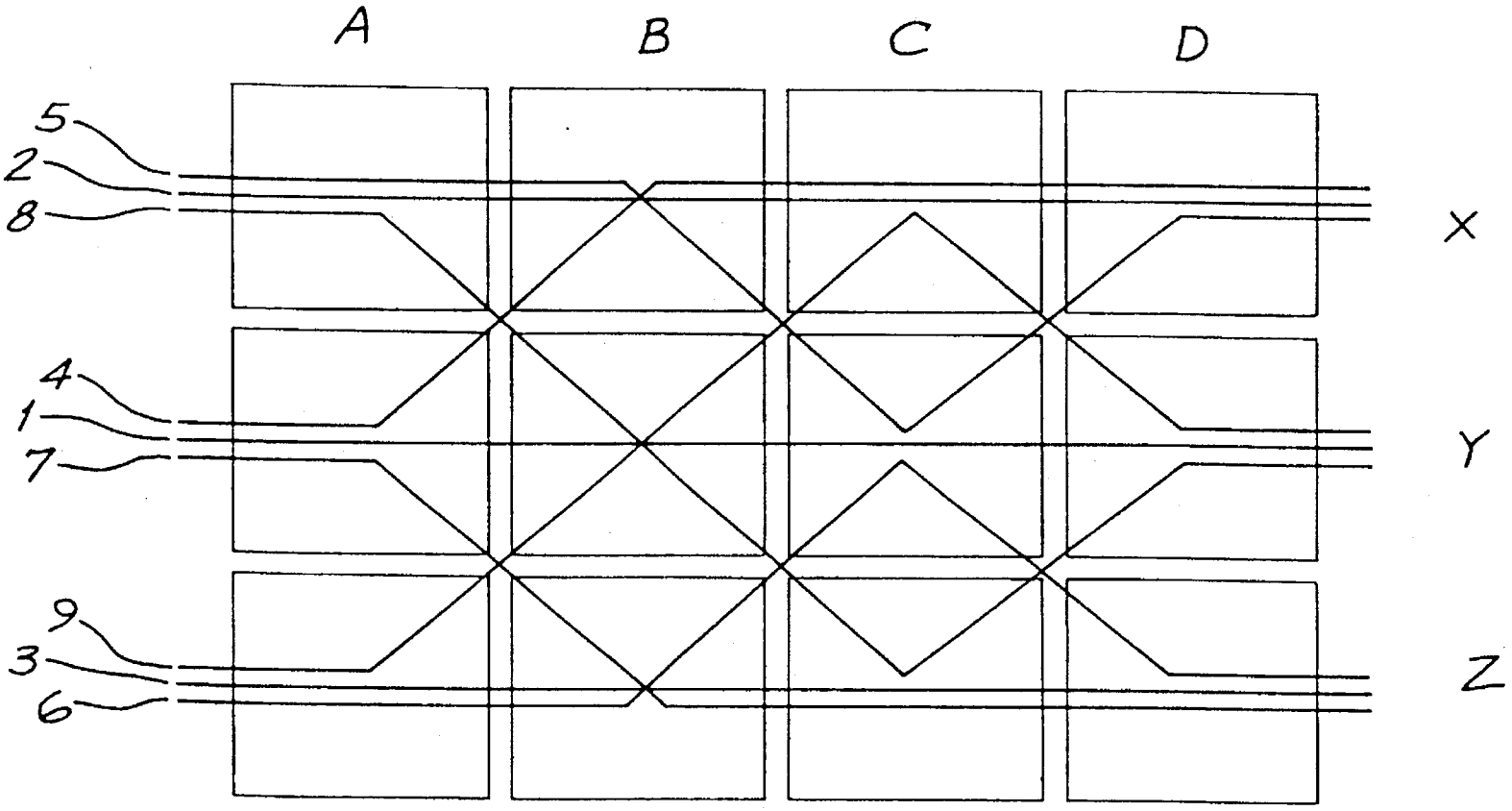
FIG. 11 diagrammatically illustrates a 9 line multi-line pay arrangement for a machine with a 3×4 display format.
Figure 12:
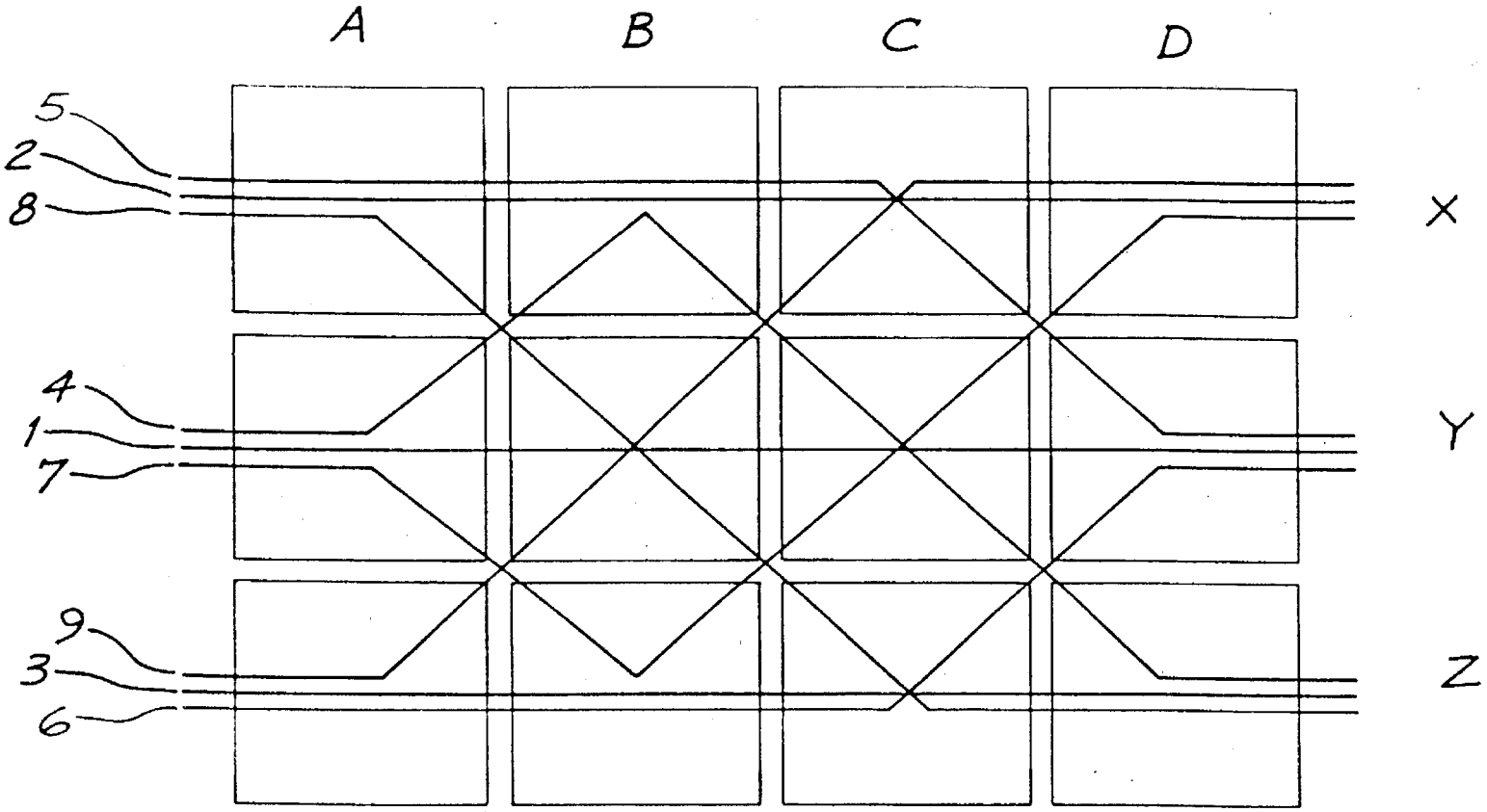
FIG. 12 diagrammatically illustrates a further 9 line multi-line pay arrangement for a machine with a 3×4 display format.

Turning to machines having 3×4 display formats, the embodiments of FIGS. 11 and 12 are two line embodiments. In the embodiment of FIG. 11 the nine lines are defined as set out in Table 9.

TABLE 9

| LINE NO | DISPLAY POSITIONS USED | | | |
|---|---|---|---|---|
| 1 | AY, | BY, | CY, | DY, |
| 2 | AX, | BX, | CX, | DX, |
| 3 | AZ, | BZ, | CZ, | DZ, |
| 4 | AY, | BX, | CX, | DX, |
| 5 | AX, | BX, | CY, | DX, |

TABLE 9-continued

| LINE NO | DISPLAY POSITIONS USED | | | |
|---|---|---|---|---|
| 6 | AZ, | BZ, | CY, | DZ, |
| 7 | AY, | BZ, | CZ, | DZ, |
| 8 | AX, | BY, | CZ, | DY, |
| 9 | AZ, | BY, | CX, | DY, |

The embodiment of FIG. 12 does not use lines 4–9 of the embodiment of FIG. 11 but instead uses the lines defined in Table 10 to achieve a nine line embodiment in a 3×4 display format.

TABLE 10

| LINE NO | DISPLAY POSITION USED | | | |
|---|---|---|---|---|
| 4 | AY, | BX, | CY, | DZ, |
| 5 | AX, | BX, | CX, | DY, |
| 6 | AZ, | BZ, | CZ, | DY, |
| 7 | AY, | BZ, | CY, | DX, |
| 8 | AX, | BY, | CZ, | DZ, |
| 9 | AZ, | BY, | CX, | DX, |

It will be recognised by persons skilled in the art that not all of the possible combinations of result lines have been exhausted in the embodiments discussed above and in particular it would be possible to produce a 15 line embodiment in a 3×3 display format by combining the embodiments of FIGS. 11 and 12.

Further embodiments of multi-line pay arrangements are illustrated in FIGS. 13–18 and defined in tables 11–16.

Figure 13:
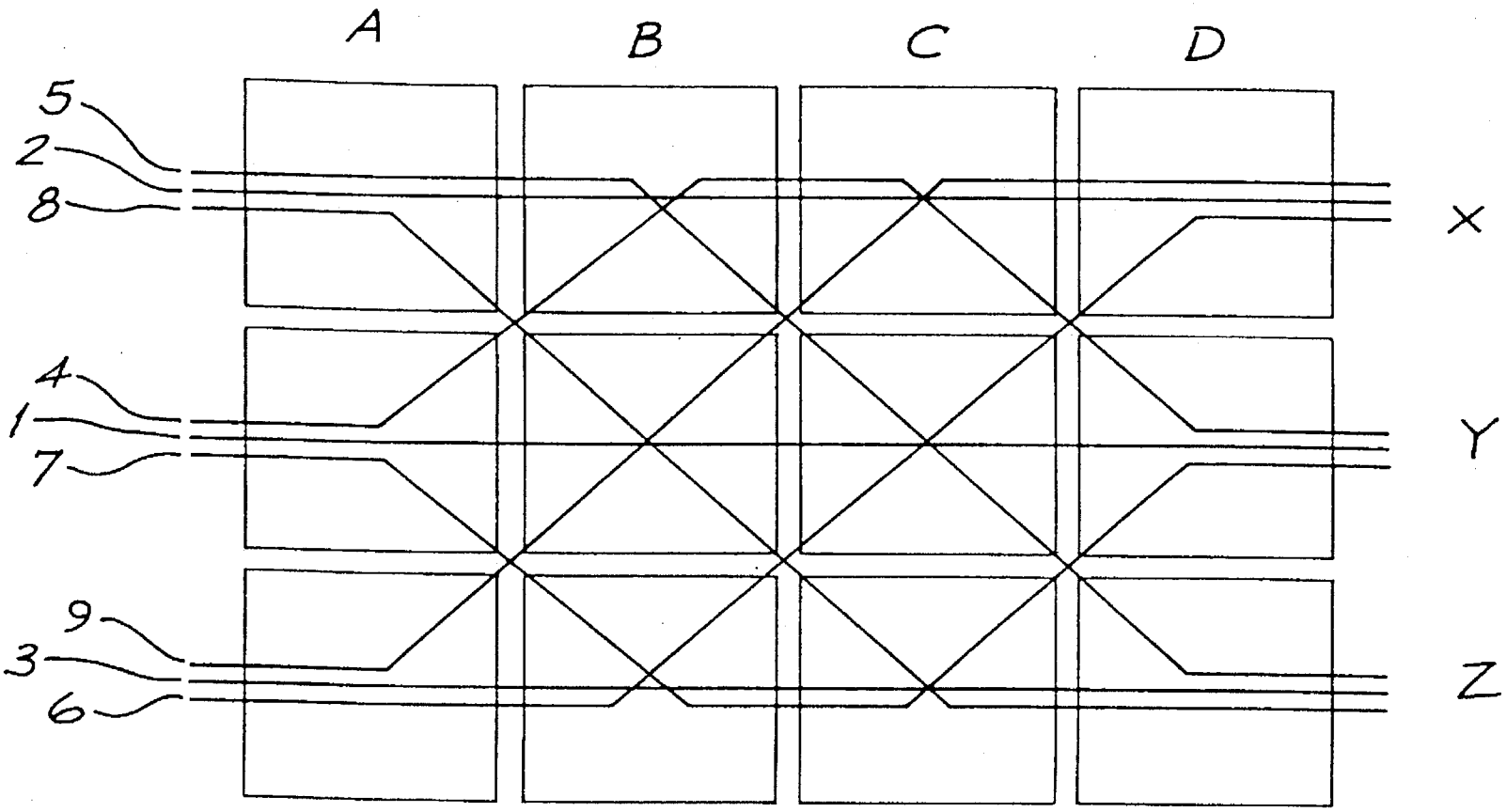
FIG. 13 diagrammatically illustrates yet another 9 line multi-line pay arrangement for a machine with a 3×4 display format.

Referring to FIG. 13 a 9 line arrangement for a 3×4 display format is defined in table 11.

TABLE 11

| LINE NO | DISPLAY POSITION USED | | | |
|---|---|---|---|---|
| 1 | AY, | BX, | CY, | DY, |
| 2 | AX, | BX, | CX, | DX, |
| 3 | AZ, | BZ, | CZ, | DZ, |
| 4 | AY, | BX, | CX, | DY, |
| 5 | AX, | BX, | CY, | DZ, |
| 6 | AZ, | BZ, | CY, | DX, |
| 7 | AY, | BZ, | CZ, | DY, |
| 8 | AX, | BY, | CZ, | DZ, |
| 9 | AZ, | BY, | CX, | DX, |

Figure 14:
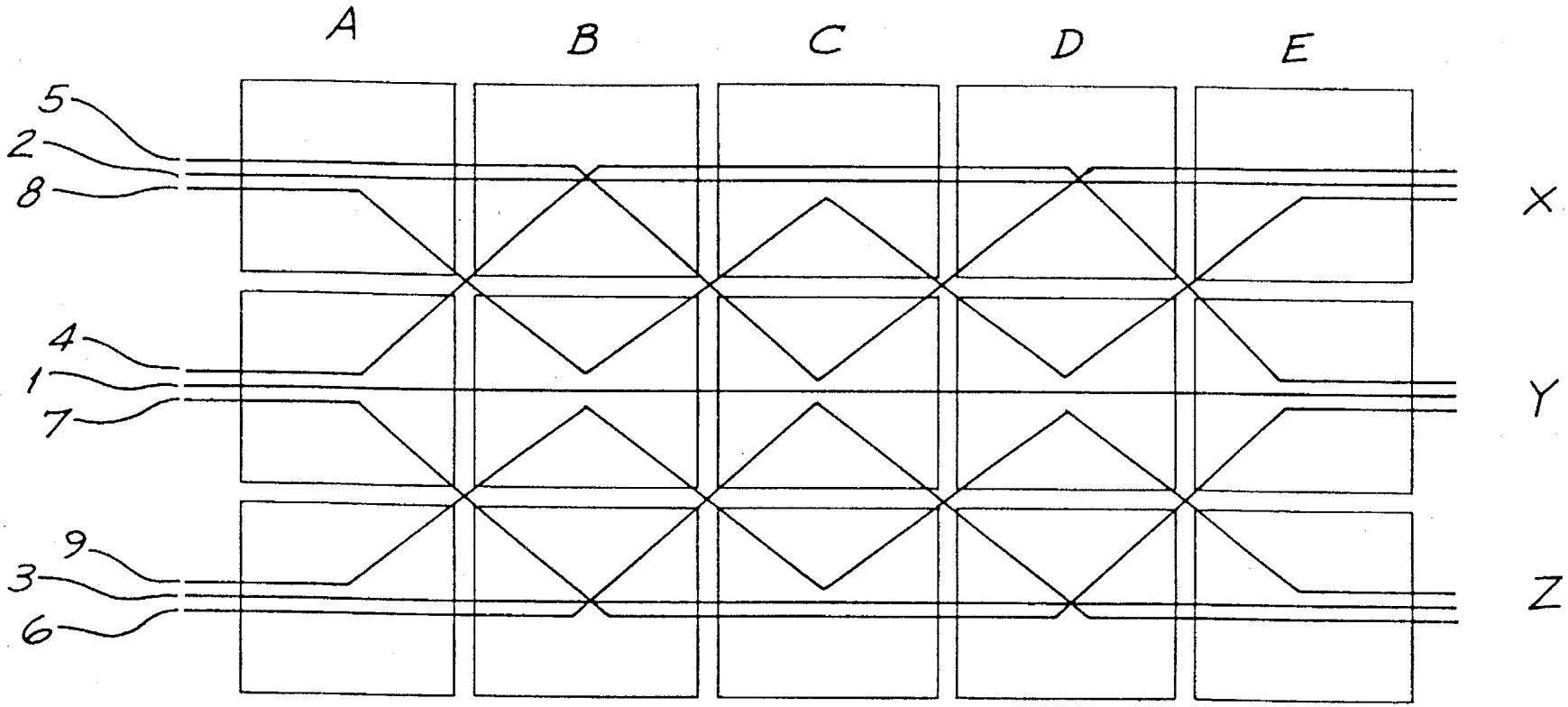
FIG. 14 diagrammatically illustrates a further 9 line multi-line pay arrangement for a machine with a 3×5 display format.

Referring to FIG. 14 a 9 line arrangement for a 3×5 display format is defined in table 12.

TABLE 12

| LINE NO | DISPLAY POSITION USED | | | | |
|---|---|---|---|---|---|
| 1 | AY, | BY, | CY, | DY, | EY |
| 2 | AX, | BX, | CX, | DX, | EX |
| 3 | AZ, | BZ, | CZ, | DZ, | EZ |
| 4 | AY, | BX, | CX, | DX, | EY |
| 5 | AX, | BX, | CY, | DX, | EX |
| 6 | AZ, | BZ, | CX, | DZ, | EZ |
| 7 | AY, | BZ, | CZ, | DZ, | EY |
| 8 | AX, | BY, | CX, | DY, | EX |
| 9 | AZ, | BY, | CZ, | DY, | EZ |

Figure 15:
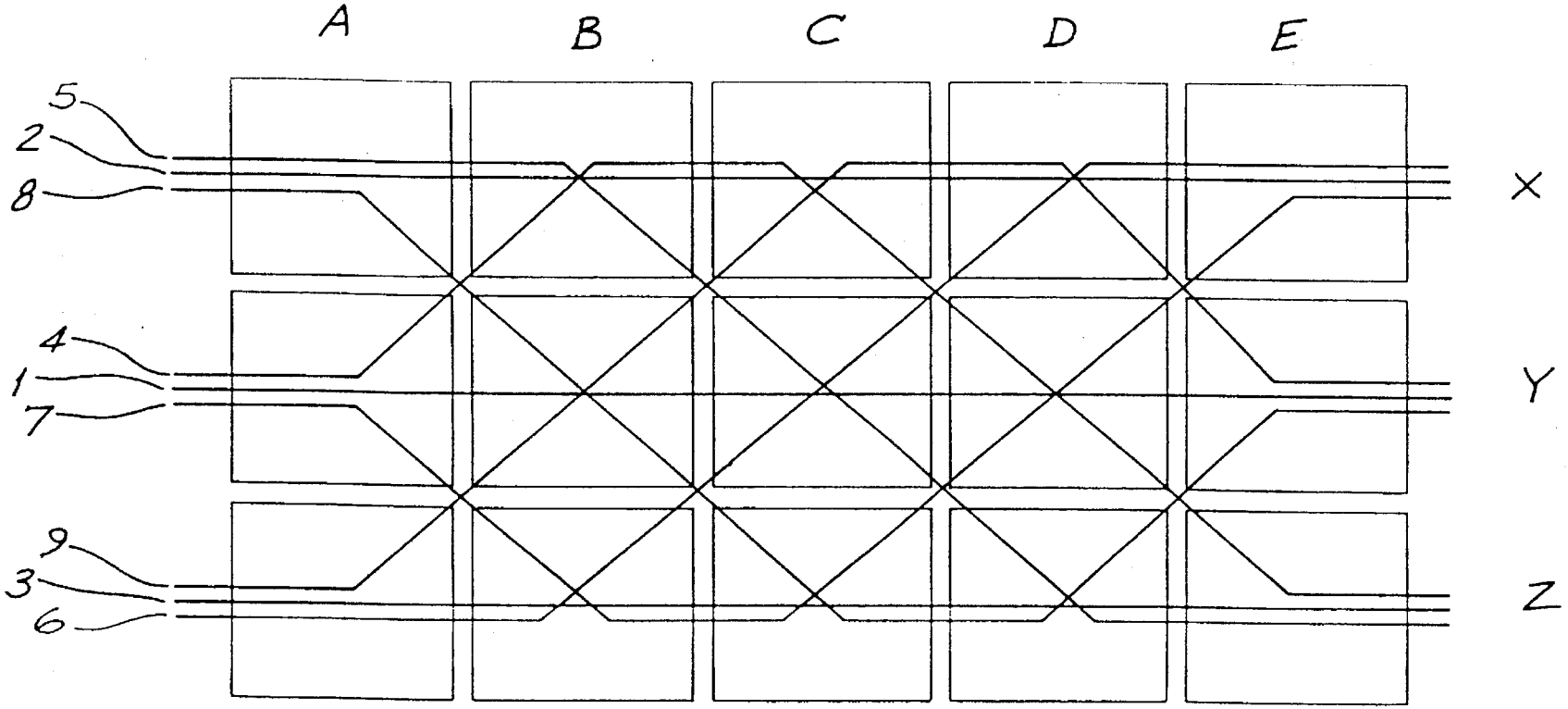
FIG. 15 diagrammatically illustrates yet another 9 line multi-line pay arrangement for a machine with a 3×5 display format.

Referring to FIG. 15 a further 9 line arrangement for a 3×5 display format is defined in table 13

TABLE 13

| LINE NO | DISPLAY POSITIONS USED | | | | |
|---|---|---|---|---|---|
| 1 | AY, | BY, | CY, | DY, | EY |
| 2 | AX, | BX, | CX, | DX, | EX |
| 3 | AZ, | BZ, | CZ, | DZ, | EZ |
| 4 | AY, | BX, | CX, | DY, | EZ |
| 5 | AX, | BX, | CY, | DZ, | EZ |
| 6 | AZ, | BZ, | CY, | DX, | EX |
| 7 | AY, | BZ, | CZ, | DY, | EX |
| 8 | AX, | BY, | CZ, | DZ, | EY |
| 9 | AZ, | BY, | CX, | DX, | EY |

Figure 16:
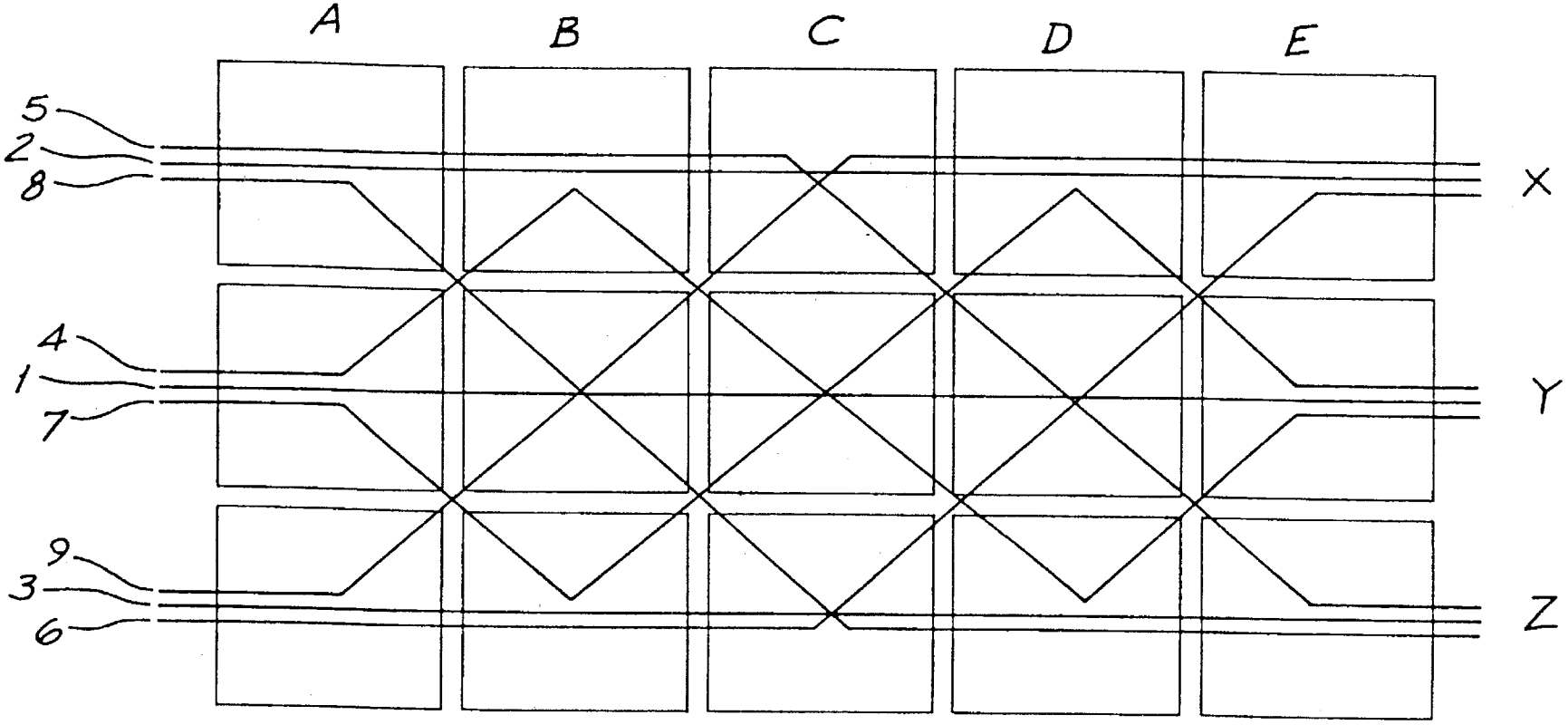
FIG. 16 diagrammatically illustrates still another 9 line multi-line pay arrangement for a machine with a 3×5 display format.

Referring to FIG. 16 yet another 9 line arrangement for a 3×5 display format is defined in table 14.

TABLE 14

| LINE NO | DISPLAY POSITION USED | | | | |
|---|---|---|---|---|---|
| 1 | AY, | BY, | CY, | DY, | EY |
| 2 | AX, | BX, | CX, | DX, | EX |
| 3 | AZ, | BZ, | CZ, | DZ, | EZ |
| 4 | AY, | BX, | CY, | DZ, | EY |
| 5 | AX, | BX, | CX, | DY, | EZ |
| 6 | AZ, | BZ, | CZ, | DY, | EX |
| 7 | AY, | BZ, | CY, | DX, | EY |
| 8 | AX, | BY, | CZ, | DZ, | EZ |
| 9 | AZ, | BY, | CX, | DX, | EX |

Figure 17:
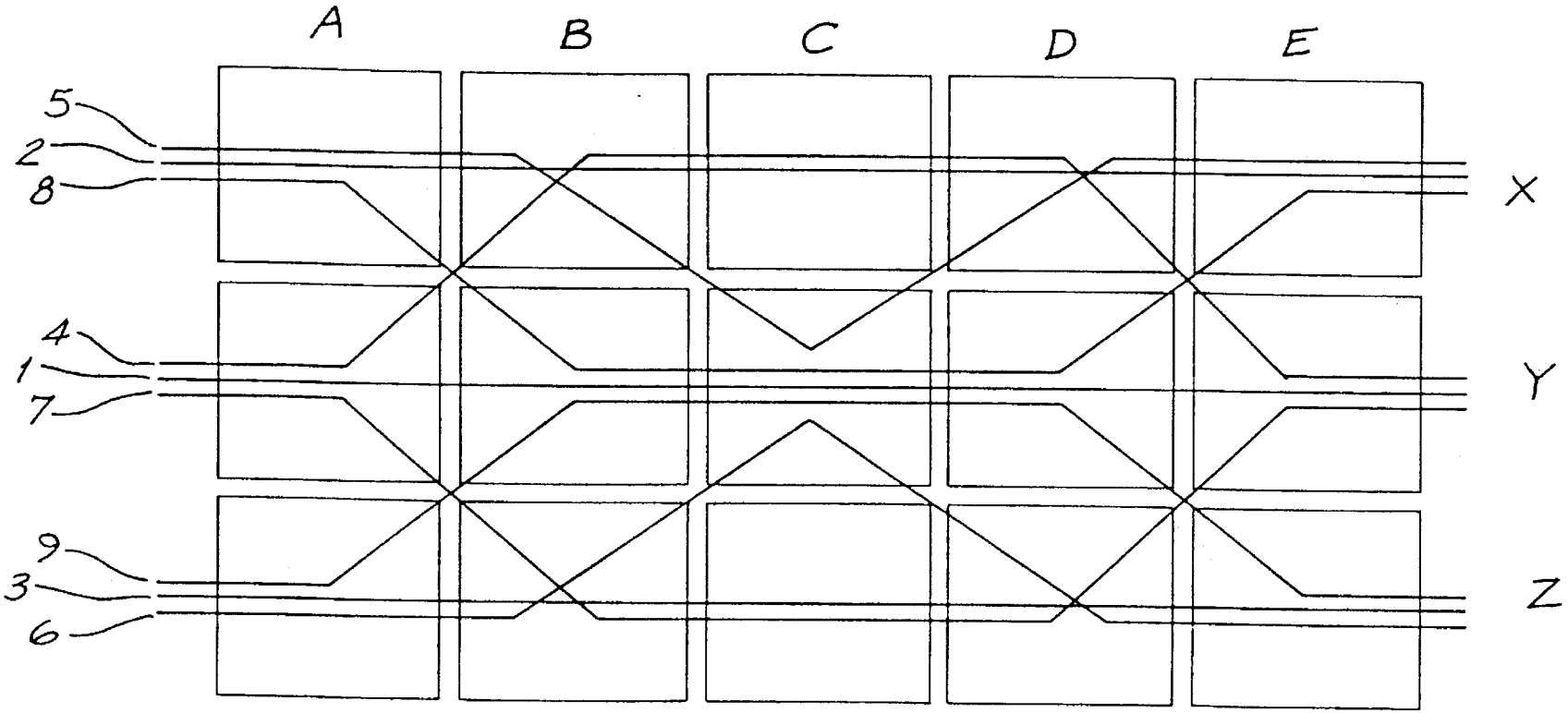
FIG. 17 diagrammatically illustrates still another 9 line multi-line pay arrangement for a machine with a 3×5 display format.

Referring to FIG. 17 yet another 9 line arrangement for a 3×5 display format is defined in table 15.

TABLE 15

| LINE NO | DISPLAY POSITION USED | | | | |
|---|---|---|---|---|---|
| 1 | AY, | BY, | CY, | DY, | EY |
| 2 | AX, | BX, | CX, | DX, | EX |
| 3 | AZ, | BZ, | CZ, | DZ, | EZ |
| 4 | AY, | BX, | CX, | DX, | EY |
| 5 | AX, | BX, | CY, | DX, | EX |
| 6 | AZ, | BZ, | CY, | DZ, | EZ |
| 7 | AY, | BZ, | CZ, | DZ, | EY |
| 8 | AX, | BY, | CY, | DX, | EX |
| 9 | AZ, | BY, | CY, | DY, | EZ |

Figure 18:
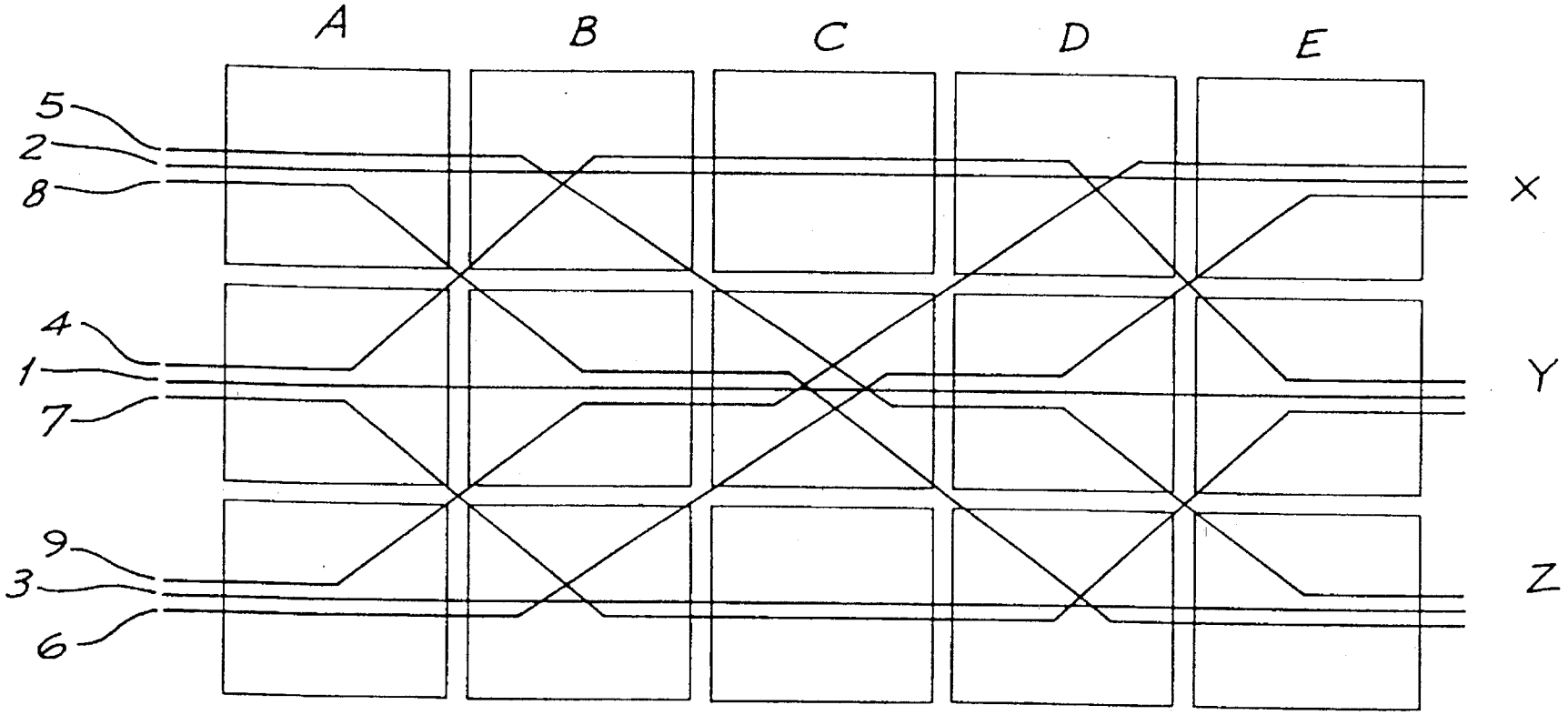
FIG. 18 diagrammatically illustrates still another 9 line multi-line pay arrangement for a machine with a 3×5 display format.

Referring to FIG. 18 yet another 9 line arrangement for a 3×5 display format is defined in table 16.

TABLE 16

| LINE NO | DISPLAY POSITIONS USED | | | | |
|---|---|---|---|---|---|
| 1 | AY, | BY, | CY, | DY, | EY |
| 2 | AX, | BX, | CX, | DX, | EX |
| 3 | AZ, | BZ, | CZ, | DZ, | EZ |
| 4 | AY, | BX, | CX, | DX, | EY |
| 5 | AX, | BX, | CY, | DY, | EZ |
| 6 | AZ, | BZ, | CY, | DY, | EX |
| 7 | AY, | BZ, | CZ, | DZ, | EY |
| 8 | AX, | BY, | CY, | DZ, | EZ |
| 9 | AZ, | BY, | CY, | DX, | EX |

All of the embodiments described above are subsets of a more general form of the invention in which up to $3^m$ lines are provided, m being the number of display columns. In this general form of the invention, a 3 column display can have 27 lines, a four column display can have 81 lines, a 5 column display can have 243 lines, a six column display can have 729 lines and a 7 column display can have 2187 lines. In this more general form of the invention, lines are not necessarily with diagonally or horizontally adjacent symbol positions in adjacent columns. Rather in this more general case every possible combination having one symbol in each column will form a line. It will be recognised however that in some instances it will be desirable to limit embodiments to less than the maximum possible number of lines.

Figure 19:
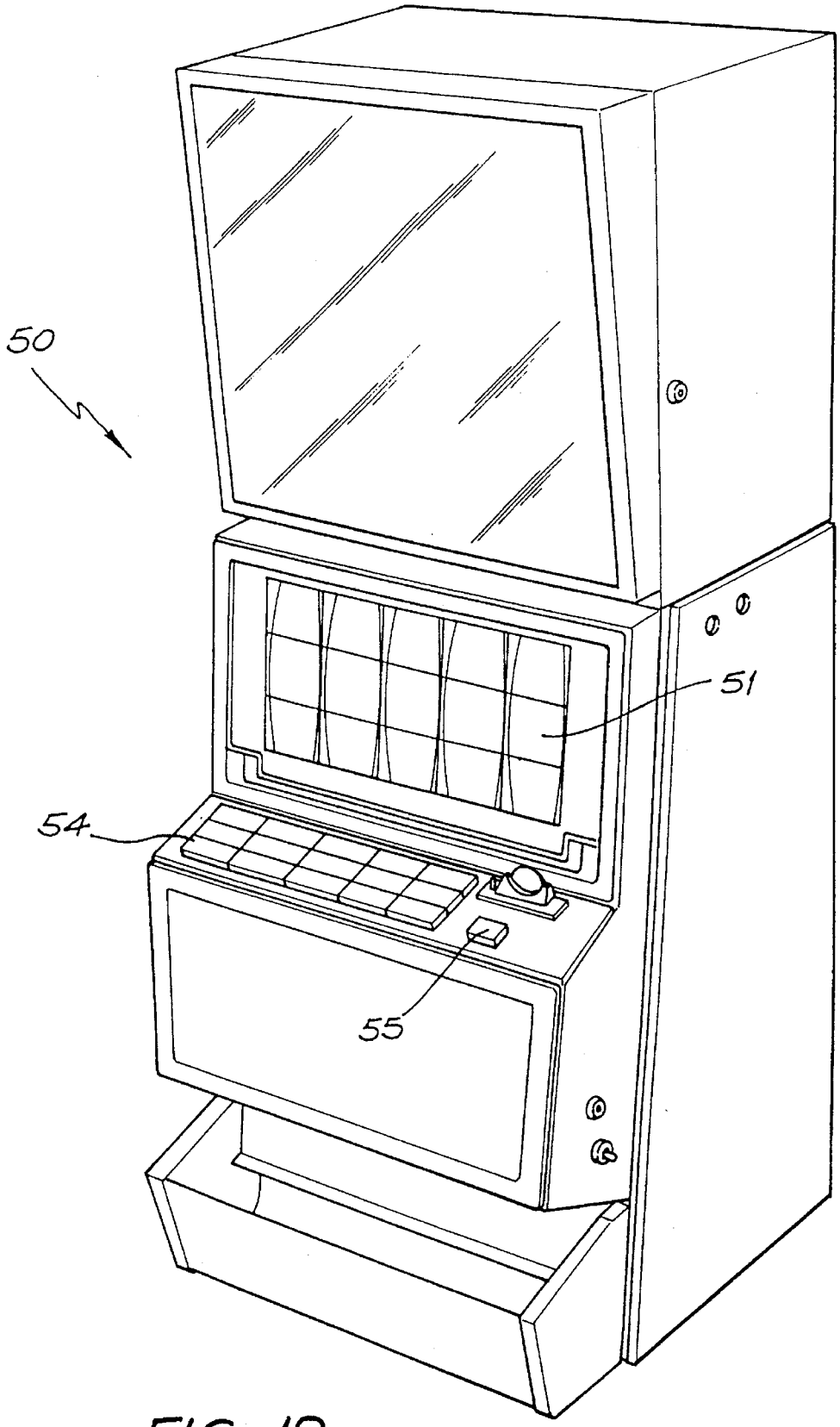
FIG. 19 illustrates a first slot machine arranged to employ a game in accordance with the present invention.

Turning to FIG. 19, a slot machine 50 is illustrated in which pay lines to be used for a game are selected via a panel of push button switches 54. In the illustrated embodiment, fifteen switches are provided to enable direct selection of 15 lines. An additional switch 54 is provided for game initiation. For embodiments in which up to 15 lines are provided, individual lines may be toggled on or off by pressing the corresponding switch in panel 54. When a line is selected a light in the corresponding switch will light to indicate the selection.

In embodiments in which more than 15 possible lines are provided, a machine could be provided with more switches in order that each line was individually selectable. However, with increasing numbers of lines this becomes more and more difficult. Alternatively, lines can be grouped and selected in those groups and for example a player might be able to select 1, 3, 5, 7, 9, 11, 13, 15, 17, 19, 21, 23, 25, 27 or 29 lines with the switch panel 54 of FIG. 19. Alternatively, more lines might be grouped together with either a reduction in the number of switches required, or an increase in the number of lines provided.

Figure 20:
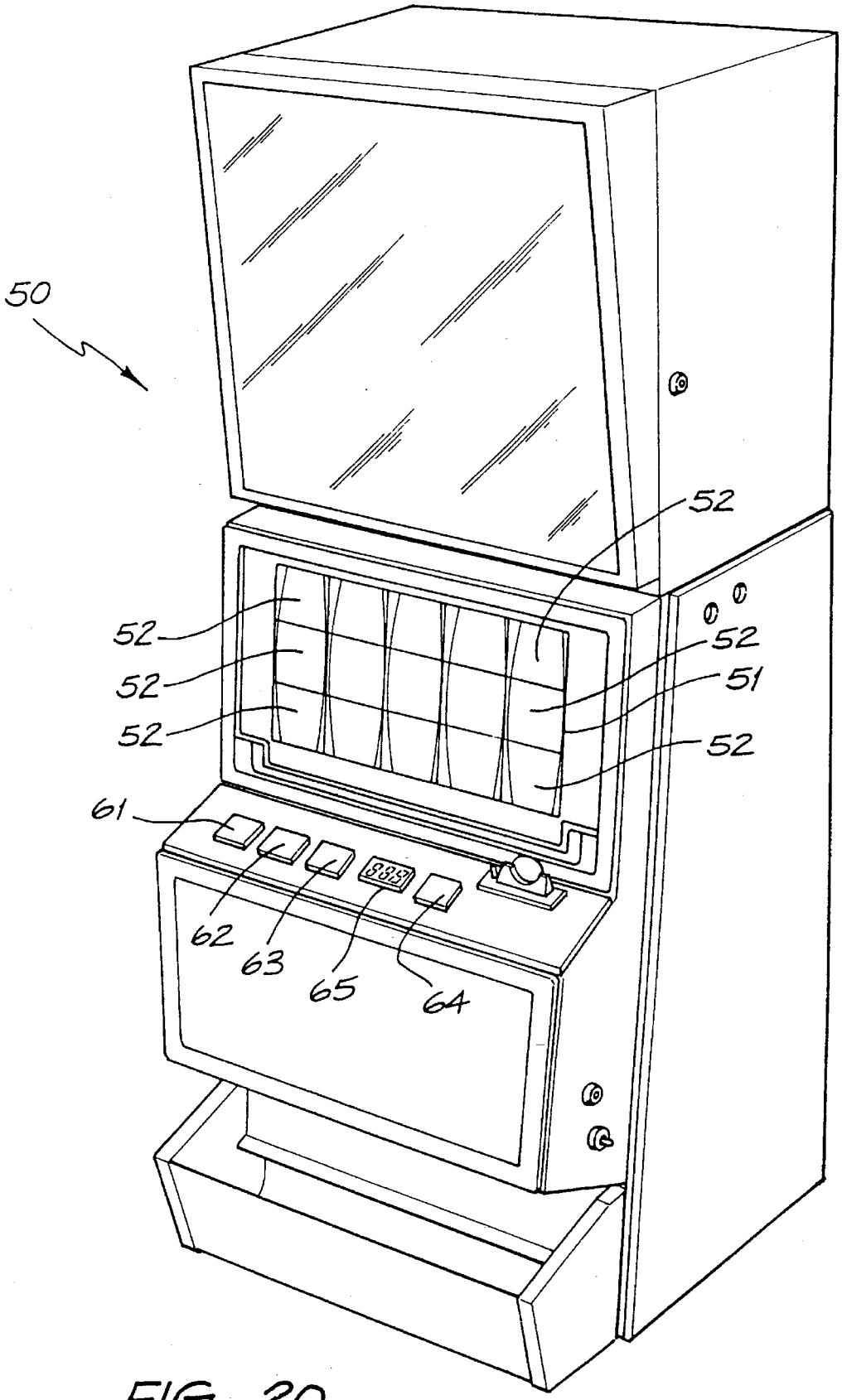
FIG. 20 illustrates a second slot machine arranged to employ a game in accordance with the present invention.

An alternative method of line selection is illustrated in FIG. 20 in which the switch panel contains only 4 switches 61, 63, 63, 64 and a line count display 65. This panel is shown in greater detail in FIG. 21, from which it will be seen that switch 61 provides a count up operation in which the count of lines selected, as indicated on the display 65, is incremented by 1 each time the switch 61 is depressed. Holding down the switch 61 for a period of time greater than 0.5 seconds will cause the display to continuously increment upwards until the button is released.

The swich 62 operates in a similar manner to switch 61 but provides a downward counting function. Switch 63 clears the count back to 1, while switch 64 causes a game to start.

Figure 21:
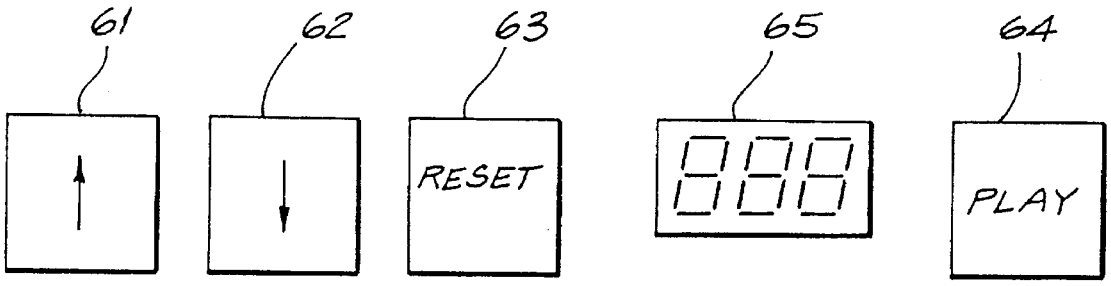
FIG. 21 illustrates a detail of a switch panel of the slot machine of FIG. 20.

It will be recognised that line selecting arrangements other than those shown in FIGS. 19–21 may be used and in particular, in the case of video machines in which the display is implemented as a video screen on which spinning wheels are simulated by video images, a touch sensitive overlay may be used in conjunction with a specially designed display to enable enhanced line selection capabilities.

Operation of the machine, apart from the line selection mechanism, will typically be as for a conventional slot machine and it will be recognised that the invention as described will be equally applicable to machines having conventional spinning reel displays which are typically driven by stepping motors and to machines of the video variety in which, as mentioned above, the display is a video screen upon which spinning reels are simulated.

It will also be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A gaming machine, comprising display means to display a plurality of symbols in an array of n rows and m columns of symbol locations, game control means to control images displayed on the display means, and to pay a prize when a predetermined combination of symbols is displayed in one of a plurality of predetermined arrangements of symbol locations of the array, each predetermined arrangement of symbol locations including one and only one symbol location in each column of the array, the machine wherein the number of predetermined arrangements of symbol locations for which the control means will pay a prize is greater than the number of rows of the array, and in that there are at least n+1 predetermined arrangements of symbol locations that include no symbol locations in at least 1 row of the array.

2. The gaming machine of claim 1 wherein at least one of the predetermined arrangements of symbol position is made up of a number of segments, each of which have no more than two symbols arranged in a straight line.

3. The gaming machine of claim 2 wherein at least one predetermined arrangement of symbol locations has more than n segments, each of which have no more than two symbols arranged in a straight line.

4. The gaming machine of claim 1 wherein at least one predetermined arrangement of symbol locations is not symmetrical about a central column of the array of symbols.

5. The gaming machine of claim 1 wherein the number of predetermined arrangements of symbol locations in which any one symbol location is included is in the range 0.7L/n to 1.5L/n where L is the total number of predetermined arrangements of symbol locations.

6. The gaming machine of claim 1 wherein the plurality of predetermined arrangements of symbol locations include all possible arrangements comprising one symbol position in each display column, whereby $n^m$ arrangements are provided.

* * * * *

US005580053C1

(12) EX PARTE REEXAMINATION CERTIFICATE (7538th)

United States Patent

Crouch

(10) Number: US 5,580,053 C1

(45) Certificate Issued: Jun. 1, 2010

(54) MULTI-LINE GAMING MACHINE

(75) Inventor: Philip C. Crouch, Vaucluse (AU)

(73) Assignee: Aristocrat Technologies Australia Pty Limited, Lane Cove, New South Wales (AU)

Reexamination Request:
No. 90/007,544, May 16, 2005

Reexamination Certificate for:

| | |
|---|---|
| Patent No.: | **5,580,053** |
| Issued: | **Dec. 3, 1996** |
| Appl. No.: | **08/360,532** |
| Filed: | **Dec. 21, 1994** |

(30) Foreign Application Priority Data

Aug. 22, 1994 (AU) ..... PM7599

(51) Int. Cl.
*G07F 17/34* (2006.01)

(52) U.S. Cl. ..... 463/20

(58) Field of Classification Search ..... None
See application file for complete search history.

(56) References Cited

U.S. PATENT DOCUMENTS

| | | | | |
|---|---|---|---|---|
| 4,198,052 A | | 4/1980 | Gauselmann | |
| 5,192,076 A | | 3/1993 | Komori | |
| RE34,244 E | | 5/1993 | Hagiwara | |
| 5,342,047 A | | 8/1994 | Heidel | |
| 5,423,539 A | * | 6/1995 | Nagao | 463/20 |
| 6,093,102 A | | 7/2000 | Bennett | |

FOREIGN PATENT DOCUMENTS

| | | |
|---|---|---|
| AU | 500709 | 12/1976 |
| AU | B-81957/87 | 2/1988 |
| DE | 25 29 930 | 12/1976 |
| DE | 79 31 812 | 2/1980 |
| DE | 31 05 266 C2 | 9/1982 |
| DE | 31 05 266 A1 | 9/1982 |
| DE | 42 26 873 | 2/1994 |
| GB | 2 119 989 | 11/1983 |
| GB | 2 137 392 | 10/1984 |
| GB | 2 150 844 | 7/1985 |
| GB | 2 187 320 | 9/1987 |
| GB | 2226907 A | 7/1990 |
| GB | 2 258 334 | 3/1993 |

OTHER PUBLICATIONS

"Order", United States District Court, District of Nevada, *Aristocrat Technologies Australia Pty. Limited, and Aristocrat Technologies, Inc.* v. *International Game Technology and IGT,* dated Apr. 20, 2007, 12 pages.

Bueschel, Richard, *Lemons, Cherries, and Bell–Fruit–Gum 259–60,* p. 293–294 (Royal Bell Books 1995) (5 pgs.).

Jolly Joker Game Specification from Jul. 1993 (19 pgs).

Turbo Reel, from Automaten Magazine, advertisements for Turbo Reel dated Dec. 1989 and Jan. 1990 (4 pgs).

Aristocrat advertisement for Dolphin Treasure game, dated Feb. 1994 (1 pg.).

(Continued)

*Primary Examiner*—Jimmy G Foster

(57) ABSTRACT

A gaming machine 50 has a display 51 on which an array of symbols is displayed. The array is typically 3 rows×5 columns and during a game the symbols displayed on the array are caused to change with a random result being obtained. The player of the machine makes a wager on the result and is paid a prize if one of a number of predetermined combinations of symbols are displayed on a line of the display 51 at the end of the game. The player may make multiple wagers on each game with each wager being assigned to a different one of a plurality of possible result lines. [typically] *Typically*, the number of possible result lines is greater than or equal to 9 and the lines to be employed in each game are selected by switches 54, prior to a game being initiated.

At the time of issuance and publication of this certificate, the patent remains subject to pending reissue application No. 12/038,412 filed Feb. 27, 2008. The claim content of the patent may be subsequently revised if a reissue patent is issued from the reissue application.

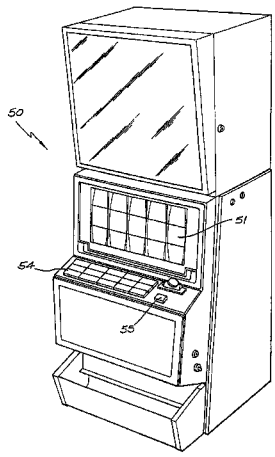

OTHER PUBLICATIONS

IGT/Aristocrat joint games, model Nos. AR007, AR009, AR010, AR011, and AR012 (5 pgs.).

Brochure for "Big Business" by Vidco, Australia (2 pgs.)

Brochure for "Money Spinner" by Vidco, Australia (1 pg.).

Brochure for "Jacks Alive" by Olympic Video Gaming, Australia (2 pgs.).

Brochure for "Magic Million" by Olympic Video Gaming, Australia (2 pgs.).

Brochure for "Hot Lava" by Pacific Gaming Pty. Ltd., Australia (2 pgs.).

Brochure for "Jackpot Cat" by Pacific Gaming Pty. Ltd., Australia (2 pgs.).

Brochure for "Jekyll & Hyde" by Pacific Gaming Pty Ltd., Australia (2 pgs.).

Brochure for "Ole", Pacific Gaming Pty. Ltd., Australia (2 pgs).

Money Spinner by Vidco, 3 pages (Jan. 7, 1994).

White Tiger by Aristocrat Technologies, Inc., 2 pages (Oct. 1993).

Loose Change, cover and pp. 18–32 (Oct. 1993).

Brochure for "Criss Cross" by Bell–Fruit Sales Division, London (1 pg).

Brochure for "Lucky Gold" by Gowerpoint Manufacturing Co. Ltd., Cardiff (1 pg).

Brochure for "Zodiac" Club Machine by Bell–Fruit Manufacturing co. Ltd., Nottingham (2 pgs).

* cited by examiner

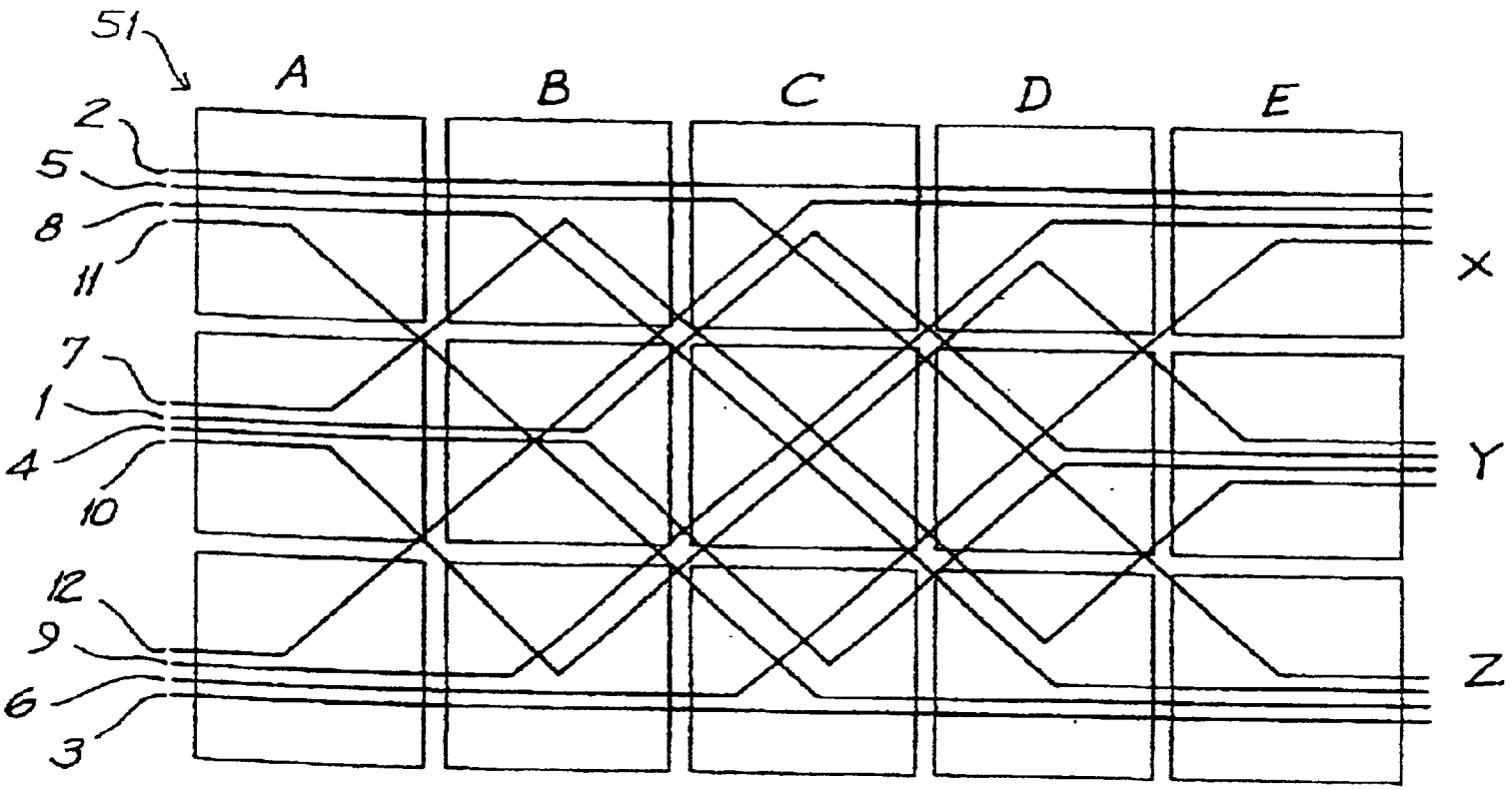
FIG. 1 AMENDED

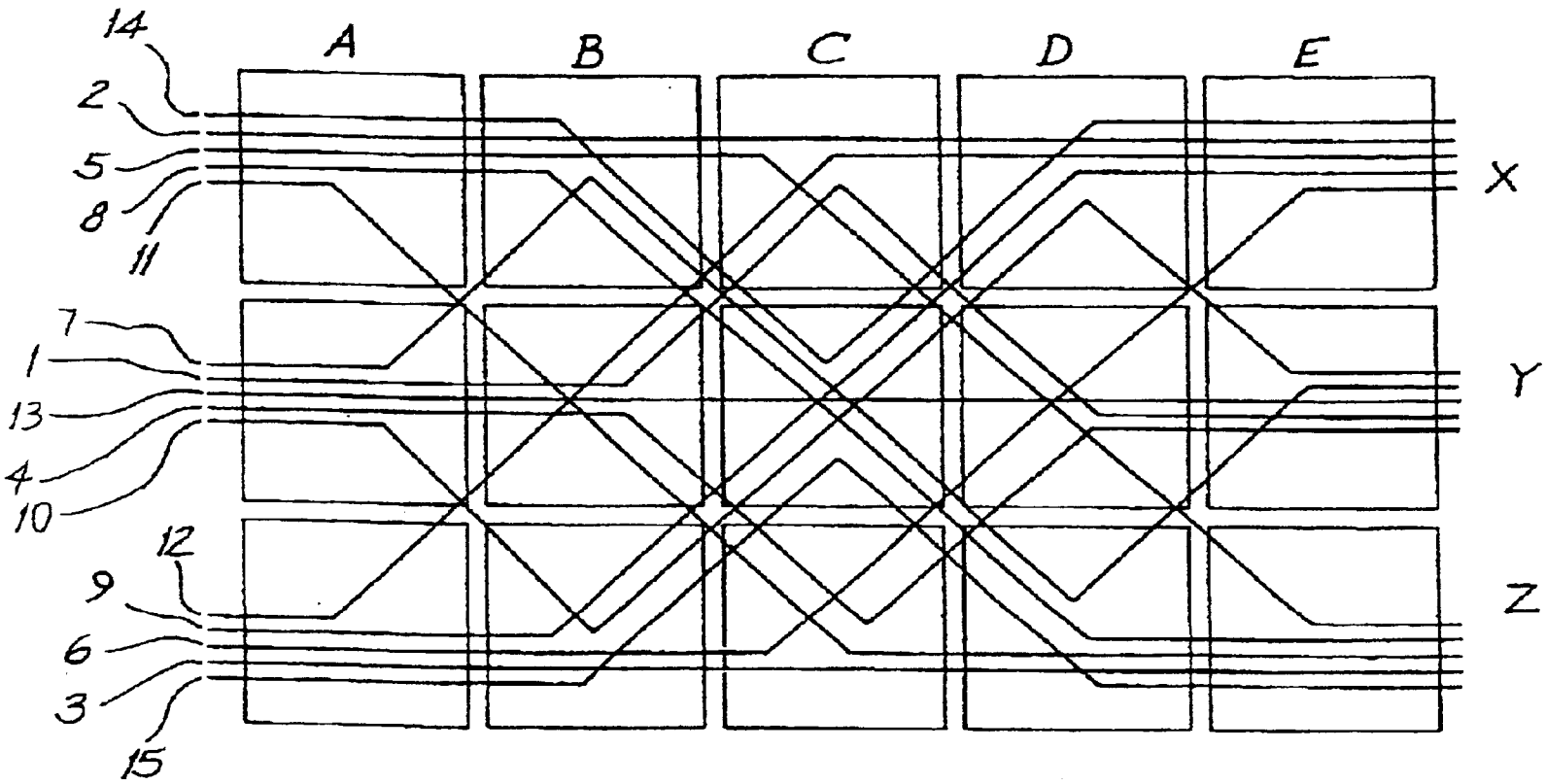
FIG. 3 AMENDED

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 31–36:

In the following detailed description, the [methodologly] *methodology* of the embodiments will be described and it is to be understood that it is within the capabilities of the non-inventive worker in the art to introduce the [methodologly] *methodology* on any standard microprocessor [base] *based* gaming machine by means of appropriate programming.

Column 4, lines 14–26:

Therefore, with this in mind the first embodiment of the present invention provides an arrangement for a slot machine having a 3×5 symbol [maxtrix] *matrix* display *51* with 12 possible pay lines as illustrated in the diagram of FIG. 1. Referring to the symbol positions *52* (*FIG. 20*) of the display by their matrix row and column designations (e.g. AX for the top left hand corner and EZ for the bottom right hand corner). It will be noted that the first row in this arrangement comprises the symbol positions AY, [EY] *BY*, CX, DY, EY and the twelfth line comprises the symbol positions AZ, BY, CX, DX, EX. All of the line combinations of FIG. 1 are illustrated in Table 1 below Column 4, lines 27–41:

TABLE 1

| LINE NO | DISPLAY POSITIONS USED | | | | |
|---|---|---|---|---|---|
| 1 | AY, | BY, | CX, | DY, | EY |
| 2 | AX, | BX, | CX, | DX, | EX |
| 3 | AZ, | BZ, | CZ, | DZ, | EZ |
| 4 | AY, | BY, | CZ, | DY, | EY |
| 5 | AX, | BX, | CX, | DY, | EZ |
| 6 | AZ, | BZ, | CZ, | DY, | EX |
| 7 | AY, | BX, | CY, | DZ, | **[**EZ**]** *EY* |
| 8 | AX, | BX, | CY, | DZ, | EZ |
| 9 | AZ, | BZ, | CY, | DX, | EX |
| 10 | AY, | BZ, | CY, | DX, | **[**EX**]** *EY* |
| 11 | AX, | BY, | CZ, | DZ, | EZ |
| 12 | AZ, | BY, | CX, | DX, | EX |
| (13) | (AY), | (BY), | (CY), | (DY), | (EY) |

Column 4, lines 59–63:

Referring to FIG. 2, the arrangement illustrated is essentially identical to that of FIG. 1 except a 13the pay line has been added, that being the horizontal centre line designated by symbol positions AY, BY, CY, DY, EY and this combination is shown in the bracketed 13th[e] line of Table 1.

Column 5, lines 12–23:

Referring to FIG. 4, this arrangement has 21 lines illustrated, fifteen of which*, namely, lines 1–7, 9, 11, 13–15, 17, 19 and 21,* are identical to those shown in FIG. 3. Four of the lines in the FIG. 4 embodiment are zig-zag lines occupying two rows of the display and alternating between those rows for each column of the display. These lines are 12, 8, [20] *10* and [13] *16*. The remaining two additional lines are lines 18 and [10] *20* and in each case these comprise two diagonal components starting at one corner of the display and progressing to the opposite vertical extremity in the centre column before returning to the original vertical extremity in the last column of the display.

Column 5, lines 26–33:

TABLE 3

| LINE NO | DISPLAY POSITIONS USED | | | | |
|---|---|---|---|---|---|
| **[**18**]** *12* | AZ, | BY, | CZ, | DY, | EZ |
| **[**21**]** *18* | AZ, | BY, | CX, | DY, | EZ |
| **[**14**]** *8* | AX, | BY, | CX, | DY, | EX |
| 20 | AX, | BY, | CZ, | DY, | EX |
| 10 | AY, | BX, | CY, | DX, | EY |
| **[**13**]** *16* | AY, | BZ, | CY, | DZ, | EY |

Column 5, lines 36–44:

Turning to FIG. 5, this is once again a twenty-one line embodiment, however, six of the lines used in the previous embodiment have been replaced, these being lines [19, 16, 8, 5, 12] *5, 2, 14, 6, 3* and 9. In each instance the lines in FIG. 5 which are different to those previously employed occupy [two] *three* rows of the display but are not zig-zag, either deviating from their original line for two or three symbol positions [before returning]. The combinations which are different are listed in Table 4 below.

Column 5, lines 46–54:

TABLE 4

| LINE NO | DISPLAY POSITIONS USED | | | | |
|---|---|---|---|---|---|
| **[**10**]** *19* | AY, | BZ, | CZ, | DZ, | EY |
| 16 | AY, | BX, | CX, | DX, | EY |
| 8 | AX, | BY, | CY, | DX, | EX |
| **[**5**]** *11* | AX, | BX, | CY, | DY, | EX |
| **[**12**]** *15* | AZ, | BY, | CY, | DZ, | EZ |
| 9 | AZ, | BZ, | CY, | DY, | EZ |

Column 5, lines 55–59:

By combining the embodiments of FIGS. 4 and 5 [(and tables 1, 2, 3, & 4),] a 27 line embodiment is achieved as illustrated in FIG. 6, while FIG. 7 shows a 9 line embodiment making use of a selection of these lines, as set out in Table 5.

Column 7,lines 35–36:

Referring to FIG. 13 a 9 line arrangement for a 3×4 display format is defined in [table] *Table* 11.

Column 7, lines 51–52:

Referring to FIG. 14 a 9 line arrangement for a 3×5 display format is defined in [table] *Table* 12.

Column 8, lines 1–2:

Referring to FIG. 15 a further 9 line arrangement for a 3×5 display format is defined in [table] *Table* 13.

Column 8, lines 15–16:

Referring to FIG. 16 yet another 9 line arrangement for a 3×5 display format is defined in [table] *Table* 14.

Column 8, lines 30–31:

Referring to FIG. 17 yet another 9 line arrangement for a 3×5 display format is defined in [table] *Table* 15.

Column 8, lines 44–45:

Referring to FIG. 18 yet another 9 line arrangement for a 3×5 display format is defined in [table] *Table* 16.

Column 9, lines 8–17:

Turning to FIG. 19, a slot machine 50 is illustrated in which pay lines to be used for a game are selected via a panel of push button switches 54. In the illustrated embodiment, fifteen switches are provided to enable direct selection of 15 lines. An additional switch [54] *55* is provided for game initiation. For embodiments in which up to 15 lines are provided, individual lines may be toggled on or off by pressing the corresponding switch in panel 54. When a line is selected a light in the corresponding switch will light to indicate the selection.

Column 9, lines 39–42:

The [swich] *switch* 62 operates in a similar manner to switch 61 but provides a downward counting function. Switch 63 clears the count back to 1, while switch 64 causes a game to start.

Column 9, lines 43–49:

It will be recongised that line selecting arrangements other than those shown in FIGS. 19–21 may be used and in particular, in the case of video machines in which the display *51* is implemented as a video screen on which spinning wheels are simulated by video images, a touch sensitive overlay may be used in conjunction with a specially designed display to enable enhanced line selection capabilities.

THE DRAWING FIGURES HAVE BEEN CHANGED AS FOLLOWS:

FIG. 1: added ref. no. "51".

FIG. 3: ref. no. "10" changed to "7"; ref. no. "4" changed to "1"; ref. no "1" changed to "13"; ref. no. "7" changed to "4"; ref. no. "13" changed to "10".

AS A RESULT OF REEXAMINATION, IT HAS BEEN DETERMINED THAT:

Claims 4–6 are cancelled.

Claims 1 and 2 are determined to be patentable as amended.

Claim 3, dependent on an amended claim, is determined to be patentable.

New claims 7–22 are added and determined to be patentable.

1. A gaming machine[.] comprising*:* display means to display a plurality of symbols in an array of n rows and m columns of symbol location[.]*; and* game control means to control images displayed on the display means[.] and to pay a prize when a predetermined combination of symbols is displayed in one of a plurality of predetermined arrangements of symbol locations of the array, each *of the plurality of* predetermined [arrangement] *arrangements* of symbol locations including one and only one symbol location in each column of the array, [the machine] wherein the number of *the plurality of* predetermined arrangements of symbol locations for which the control means will pay a prize is greater than the [number of] *n* rows of the array, and in that there are at least n+1 *of the plurality of* predetermined arrangements of symbol locations that include no symbol locations in at least 1 row of the array*, and means for selecting a plurality of predetermined arrangements of symbol locations, but not all, by making one of a plurality of possible initial wager options, wherein at least one of the selected predetermined arrangements of symbol locations is not symmetrical about one or more central columns of the array of symbols*.

2. The gaming machine of claim 1 wherein at least one of the predetermined arrangements of symbol [position] *locations* is made up of a number of segments, each of which have no more than two symbols arranged in a straight line.

*7. A gaming machine comprising:*

*display means to display a plurality of symbols in an array of n rows and m columns of symbol locations, where n=3 and m=5;*

*game control means to control images displayed on the display means and to pay a prize when a predetermined combination of symbols is displayed in one of a plurality of predetermined arrangements of symbol locations of the array, each of the plurality of predetermined arrangements of symbol locations including one and only one symbol location in each column of the array, wherein the number of the plurality of predetermined arrangements of symbol locations for which the control means will pay a prize is greater than the n rows of the array, and in that there are at least n+1 of the plurality of predetermined arrangements of symbol locations that include no symbol locations in at least 1 row of the array; and*

*means for selecting predetermined arrangements of symbol locations, but not all, by making one of a plurality of possible initial wager options, wherein at least one of the selected predetermined arrangements of symbol locations is not symmetrical about a central column of the array of symbols.*

*8. The gaming machine of claim 7, wherein the number of selected predetermined arrangements of symbol locations is greater than the n rows of the array but less than* $n^m$.

*9. The gaming machine of claim 7, wherein at least one of the selected predetermined arrangements of symbol locations is made up of a plurality of straight line segments, each of which have no more than two symbols arranged in a straight line.*

*10. The gaming machine of claim 7, wherein at least one of the selected predetermined arrangements of symbol locations has more than n straight line segments.*

*11. The gaming machine of claim 7, wherein the number of said predetermined arrangements of symbol locations in which any one symbol location is included is in the range (0.7)l/n to (1.5)l/n where 1 is the total number of predetermined arrangements of symbol locations.*

*12. The gaming machine of claim 7, wherein said game control means is arranged to provide wager options including at least n+8 predetermined arrangements of symbol locations that include no symbol locations in at least 1 row of the array.*

*13. The gaming machine of claim 7, wherein said game control means is for presenting to the player a set of options for between 3 and 15 predetermined arrangements of symbol locations.*

*14. A gaming machine comprising:*

*a display to display a plurality of symbols in an array of n rows and m columns of symbol locations, where n=3 and m=5;*

*a microprocessor programmed to control images displayed on the display and to pay a prize when a predetermined combination of symbols is displayed in one of a plurality of predetermined symbol locations of the*

*array, each of the plurality of predetermined arrangements of symbol locations including one and only one symbol location in each column of the array, wherein the number of the plurality of predetermined arrangements of symbol locations for which the microprocessor will pay a prize is greater than the n rows of the array, and in that there are at least n+1 of the plurality of predetermined arrangements of symbol locations that include no symbol locations in at least 1 row of the array; and*

*selecting means to select a plurality, but not all, of the predetermined arrangements of symbol locations in the array, wherein at least one of the selected predetermined arrangements of symbol locations is not symmetrical about a central column of the array of symbols.*

*15. The gaming machine of claim 14, wherein the number of selected predetermined arrangements of symbol locations is greater than the n rows of the array but less than* $n^m$.

*16. A gaming machine comprising:*

*a display to display a plurality of symbols in an array of n rows and m columns of symbol locations, where n=3 and m=4;*

*a microprocessor programmed to control images displayed on the display and to pay a prize when a predetermined combination of symbols is displayed in one of a plurality of predetermined symbol locations of the array, each of the plurality of predetermined arrangements of symbol locations including one and only one symbol location in each column of the array, wherein the number of the plurality of predetermined arrangements of symbol locations for which the microprocessor will pay a prize is greater than the n rows of the array, and in that there are at least n+1 of the plurality of predetermined arrangements of symbol locations that include no symbol locations in at least 1 row of the array; and*

*selecting means to select a plurality, but not all, of the predetermined arrangements of symbol locations in the array, wherein at least one of the selected predetermined arrangements of symbol locations is not symmetrical about a central column of the array of symbols.*

*17. The gaming machine of claim 16, wherein the number of selected predetermined arrangements of symbol locations is greater than the n rows of the array but less than* $n^m$.

*18. A gaming machine, comprising:*

*display means to display a plurality of symbols in an array of n rows and m columns of symbol locations;*

*game control means to control images displayed on the display means and to pay a prize when a predetermined combination of symbols is displayed in one of a plurality of predetermined line arrangements of symbol locations of the array, each of the plurality of predetermined line arrangements of symbol locations including one and only one symbol location in each column of the array, wherein the number of the plurality of predetermined line arrangements of symbol locations for which the control means will pay a prize is greater than the number of n rows of the array, and in that there are at least n+1 of the plurality of predetermined line arrangements of symbol locations that include no symbol locations in at least 1 row of the array; and*

*a plurality of switches for selecting a plurality of particular, but not all, predetermined line arrangements of symbol locations of the array for assigning concurrent bets on the selected line arrangements of symbol locations, wherein at least one of the selected line arrangements is not symmetrical about a central column of the array of symbols.*

*19. The gaming machine of claim 18, wherein the number of selected line arrangements is more than n but less than* $n^m$.

*20. The gaming machine of claim 18, wherein each of the plurality of switches is associated with two or more of the plurality of predetermined line arrangements, wherein selection of one of the plurality of switches automatically selects a plurality of predetermined line arrangements.*

*21. The gaming machine of claim 14, wherein the selecting means selects the plurality of predetermined arrangements of symbol locations in the array for placing concurrent bets on particular predetermined arrangements of symbol locations.*

*22. The gaming machine of claim 16, wherein the selecting means selects the plurality of predetermined arrangements of symbol locations in the array for placing concurrent bets on particular predetermined arrangements of symbol locations.*

* * * * *